US011638980B2

(12) United States Patent
Kobayashi et al.

(10) Patent No.: US 11,638,980 B2
(45) Date of Patent: May 2, 2023

(54) LAMINATED MEMBRANE, SUBSTRATE HOLDER INCLUDING LAMINATED MEMBRANE, AND SUBSTRATE PROCESSING APPARATUS

(71) Applicant: EBARA CORPORATION, Tokyo (JP)

(72) Inventors: Kenichi Kobayashi, Tokyo (JP); Asagi Matsugu, Tokyo (JP); Makoto Kashiwagi, Tokyo (JP); Manao Hoshina, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 236 days.

(21) Appl. No.: 16/825,799

(22) Filed: Mar. 20, 2020

(65) Prior Publication Data

US 2020/0316747 A1 Oct. 8, 2020

(51) Int. Cl.
*B24B 37/32* (2012.01)
*B24B 37/005* (2012.01)

(52) U.S. Cl.
CPC ..... *B24B 37/32* (2013.01); *B24B 37/005* (2013.01)

(58) Field of Classification Search
CPC ..... B24B 37/32; B24B 37/005; B24B 37/27; B24B 37/30
USPC ..... 451/9
See application file for complete search history.

(56) References Cited

U.S. PATENT DOCUMENTS

| | | | | |
|---|---|---|---|---|
| 5,584,746 | A * | 12/1996 | Tanaka | B24B 37/30 451/388 |
| 6,080,050 | A * | 6/2000 | Chen | B24B 37/30 451/388 |
| 6,110,026 | A | 8/2000 | Arai | |
| 2006/0089092 | A1* | 4/2006 | Chen | B24B 37/30 451/402 |
| 2009/0111362 | A1 | 4/2009 | Nabeya et al. | |
| 2015/0273657 | A1 | 10/2015 | Fukushima et al. | |
| 2016/0129547 | A1* | 5/2016 | Duescher | B24B 37/30 451/259 |
| 2017/0057049 | A1 | 3/2017 | Fukushima et al. | |
| 2017/0144267 | A1 | 5/2017 | Fukushima et al. | |
| 2018/0158707 | A1* | 6/2018 | Hunter | G06K 7/10366 |

FOREIGN PATENT DOCUMENTS

| | | | |
|---|---|---|---|
| JP | 2000-015572 | A | 1/2000 |
| JP | 2006-332520 | A | 12/2006 |
| JP | 2009-131946 | A | 6/2009 |
| JP | 2015-193070 | A | 11/2015 |
| JP | 2017-047503 | A | 3/2017 |
| JP | 2018-183820 | A | 11/2018 |

* cited by examiner

*Primary Examiner* — Don M Anderson
*Assistant Examiner* — Caleb Andrew Holizna
(74) *Attorney, Agent, or Firm* — BakerHostetler

(57) ABSTRACT

An elastic member that includes a plurality of pressure chambers is manufactured without using a mold having a complicated shape. According to one embodiment, a laminated membrane used in a substrate holder of a substrate processing apparatus is provided. Such a laminated membrane includes a first sheet material and a second sheet material disposed on the first sheet material. A part of the first sheet material is secured to a part of the second sheet material.

6 Claims, 17 Drawing Sheets

LAMINATED MEMBRANE, SUBSTRATE HOLDER INCLUDING LAMINATED MEMBRANE, AND SUBSTRATE PROCESSING APPARATUS

CROSS-REFERENCE TO RELATED APPLICATION

This application is based upon and claims the benefit of priority of the prior Japanese Patent Application No. 2019-70612, filed on Apr. 2, 2019, the entire content of which is incorporated herein by reference.

TECHNICAL FIELD

The present invention relates to a laminated membrane, a substrate holder including the laminated membrane, and a substrate processing apparatus.

BACKGROUND ART

For manufacturing a semiconductor device, a chemical mechanical polishing (CMP) apparatus is used for flattening a surface of a substrate. The substrate used in manufacturing the semiconductor device is often in a circular plate shape. Not limited to the semiconductor device, there is an increasing request for a flatness when a surface of a square-shaped substrate, such as a Copper Clad Laminate substrate (CCL substrate), a Printed Circuit Board (PCB) substrate, a photomask substrate, and a display panel, is flattened. There is also an increasing request for flattening a surface of a package substrate on which an electronic device, such as a PCB substrate, is disposed.

CITATION LIST

Patent Literature

PTL 1: Japanese Unexamined Patent Application Publication No. 2018-183820

PTL 2: Japanese Unexamined Patent Application Publication No. 2009-131946

SUMMARY OF INVENTION

Technical Problem

In the CMP apparatus, a substrate as a polishing object is held by a top ring, and while the substrate is pressed onto a polishing pad disposed on a polishing table, the substrate and the polishing pad are relatively moved (for example, rotated), and thus, the substrate is polished. In order to uniformly polish the substrate, contact pressures onto the polishing pad are sometimes controlled for each region of the substrate. for example, the contact pressures onto the polishing pad can be controlled for each region of the substrate by disposing an elastic member including a plurality of pressure chambers on a substrate holding surface of the top ring and controlling pressures of the respective pressure chambers (for example, PTL 1 and 2)

Such an elastic member is required to be formed so as to include the plurality of pressure chambers, thereby having a complicated shape in many cases. The elastic member having a complicated shape can be manufactured by a mold having a corresponding shape. However, a fabrication of a mold having a complicated shape costs money and time. The substrate polished by the CMP apparatus as described above has atypical variously-sized square-shaped substrates, not only a standardized fixed-sized semiconductor substrate as conventional. Designing elastic members so as to correspond to variously-sized substrates and fabricating molds so as to correspond to the respective designs greatly increase a cost and a time load. Therefore, manufacturing an elastic member including a plurality of pressure chambers without using a mold having a complicated shape provides a benefit.

Solution to Problem

According to one embodiment, a laminated membrane used in a substrate holder of a substrate processing apparatus is provided. Such a laminated membrane includes a first sheet material, and a second sheet material disposed on the first sheet material. A part of the first sheet material is secured to a part of the second sheet material.

DESCRIPTION OF EMBODIMENTS

Figure 1:
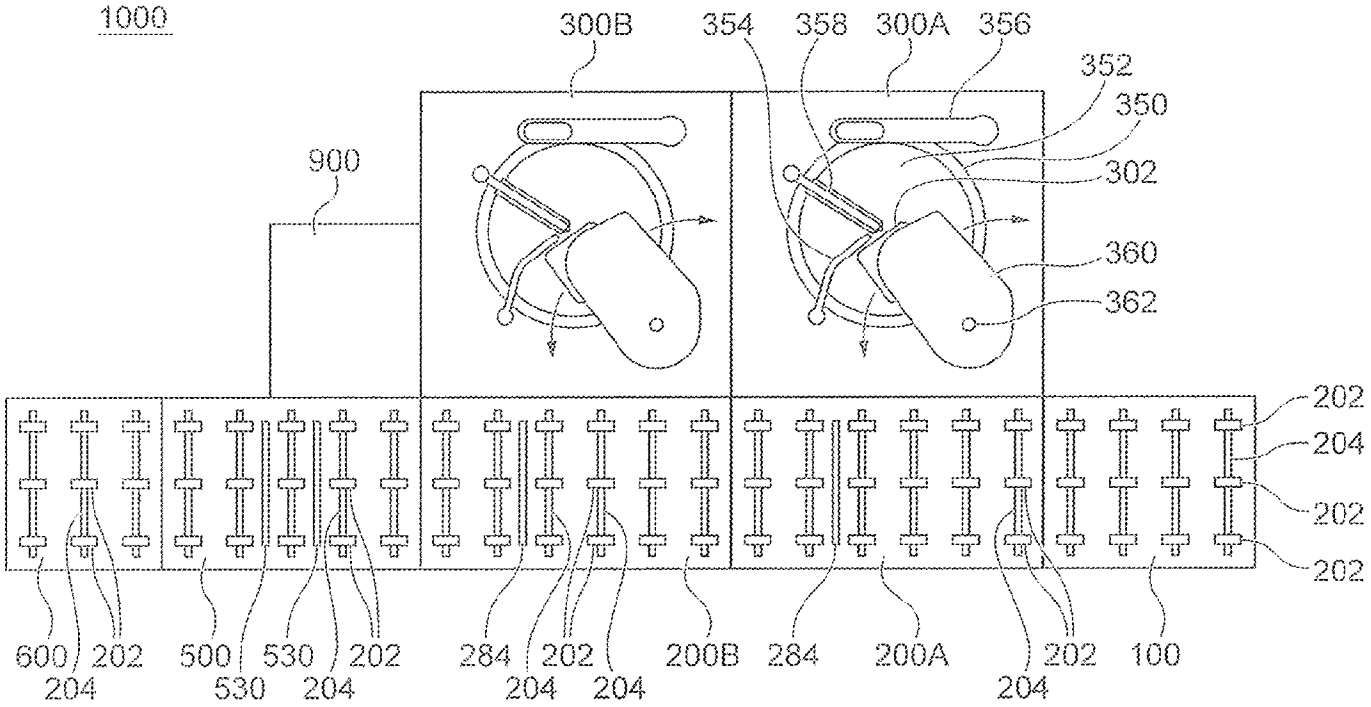
FIG. 1 is a plan view illustrating an overall configuration of a substrate processing apparatus according to one embodiment.

The following describes a laminated membrane, a method for manufacturing the laminated membrane, and a substrate processing apparatus including the laminated membrane according to the present invention with the attached drawings. In the attached drawings, identical or similar reference numerals are attached to identical or similar components, and overlapping description regarding the identical or similar components may be omitted in the description of the respective embodiments. Features illustrated in the respective embodiments are applicable to other embodiments in so far as they are consistent with one another. Note that, in the description, a "substrate" includes a magnetic recording medium, a magnetic recording sensor, a mirror, an optical element, a micro mechanical element, or a partially fabricated integrated circuit, not only a semiconductor substrate, a glass substrate, or a printed circuit board.

FIG. 1 is a plan view illustrating an overall configuration of a substrate processing apparatus 1000 according to one embodiment. The substrate processing apparatus 1000 illustrated in FIG. 1 includes a loading unit 100, a conveyance unit 200, a polishing unit 300, a drying unit 500, and an unloading unit 600. In the illustrated embodiment, the conveyance unit 200 includes two conveyance units 200A and 200B, and the polishing unit 300 includes two polishing units 300A and 300B. In one embodiment, these units can be each independently formed. Independently forming these units ensures easily forming the substrate processing apparatus 1000 in a different configuration by conveniently combining the number of respective units. The substrate processing apparatus 1000 includes a controller 900, and each configuration member of the substrate processing apparatus 1000 is controlled by the controller 900. In one embodiment, the controller 900 can be configured of a general computer that includes, for example, an input/output device, an arithmetic device, and a storage device.

<Loading Unit>

Figure 2:
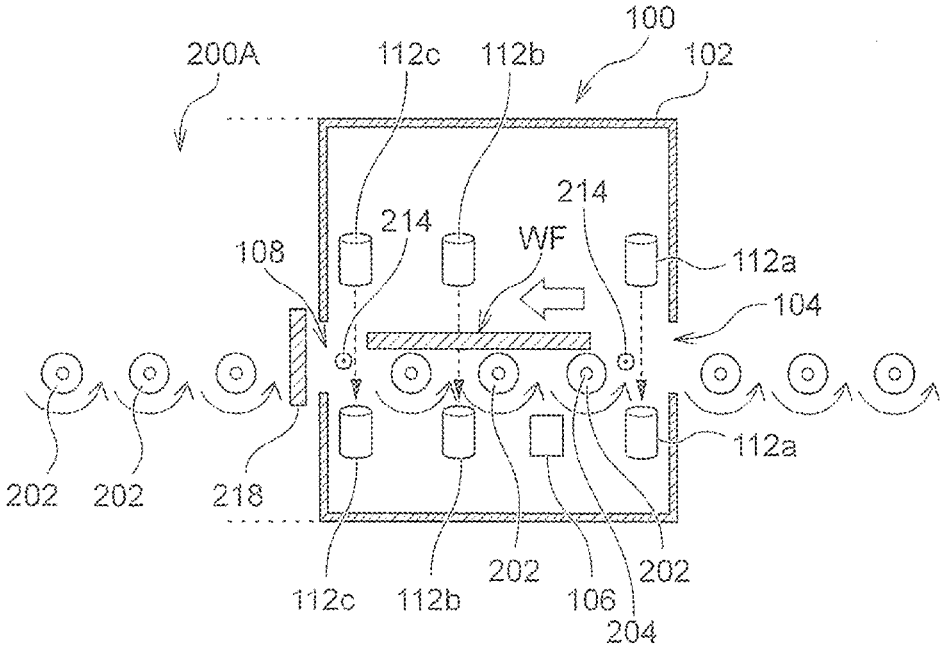
FIG. 2 is a side view schematically illustrating a loading unit according to one embodiment.

The loading unit 100 is a unit for introducing a substrate WF before processes, such as polishing and cleaning, are performed into the substrate processing apparatus 1000. FIG. 2 is a side view schematically illustrating the loading unit 100 according to one embodiment. In one embodiment, the loading unit 100 includes a housing 102. The housing 102 has an inlet opening 104 on a side from which the substrate WF is received. In the embodiment illustrated in FIG. 2, the right side is the inlet side. The loading unit 100 receives the substrate WF as a process target from the inlet opening 104. The loading unit 100 has an upper stream (the right side in FIG. 2) where a processing apparatus is arranged. The processing apparatus is where treatment processes before the process of the substrate WF by the substrate processing apparatus 1000 according to the disclosure is performed. In the embodiment illustrated in FIG. 2, the loading unit 100 includes an ID reader 106. The ID reader 106 reads an ID of the substrate received from the inlet opening 104. The substrate processing apparatus 1000 performs various processes on the substrate WF corresponding to the read ID. In one embodiment, the ID reader 106 is not necessarily disposed. In one embodiment, the loading unit 100 is configured so as to be compliant to a mechanical equipment interface standard (IPC-SMEMA-9851) of Surface Mount Equipment Manufacturers Association (SMEMA).

In the embodiment illustrated in FIG. 2, the loading unit 100 includes a plurality of conveyance rollers 202 for conveying the substrate WF. Rotating the conveyance rollers 202 with a configuration similar to a rotation mechanism in the conveyance unit described below ensures conveying the substrate WF on the conveyance rollers 202 in a predetermined direction (the left direction in FIG. 2). In the illustrated drawing, the housing 102 of the loading unit 100 has an outlet opening 108 of the substrate WF. The loading unit 100 includes a sensor 112 for sensing a presence/absence of the substrate WF at a predetermined position on the conveyance rollers 202. The sensor 112 can be a sensor of any format, for example, can be an optical sensor. In the embodiment illustrated in FIG. 2, three sensors 112 are disposed in the housing 102. One is a sensor 112*a* disposed in the proximity of the inlet opening 104, one is a sensor 112*b* disposed in the proximity of a center of the loading unit 100, and the other one is a sensor 112*c* disposed in the proximity of the outlet opening 108. In one embodiment, corresponding to the detection of the substrate WF by these sensors 112, an operation of the loading unit 100 can be controlled. For example, when the sensor 112*a* near the inlet opening 104 detects the presence of the substrate WF, the conveyance roller 202 inside the loading unit 100 may start to rotate, or a rotation speed of the conveyance roller 202 may be changed. When the sensor 112*c* near the outlet opening 108 detects the presence of the substrate WF, an inlet shutter 218 of the conveyance unit 200A, which is a subsequent unit, may open.

In the illustrated embodiment, a conveying mechanism of the loading unit 100 includes the plurality of conveyance rollers 202 and a plurality of roller shafts 204 on which the conveyance rollers 202 are mounted. In the embodiment according to FIG. 1, three conveyance rollers 202 are mounted on each of the roller shafts 204. The substrate WF is disposed on the conveyance rollers 202, and the rotation of the conveyance rollers 202 conveys the substrate WF. Installation positions of the conveyance rollers 202 on the roller shaft 204 can be anywhere as long as the substrate WF can be stably conveyed with the positions. However, since the conveyance rollers 202 are brought into contact with the substrate WF, the conveyance rollers 202 should be disposed so as to be in a contact with a region without any problem of contacting the substrate WF as the process target. In one embodiment, the conveyance rollers 202 of the loading unit 100 can be constituted of a conductive polymer. In one embodiment, the conveyance rollers 202 are electrically grounded via the roller shafts 204 and the like. This is for avoiding the substrate WF from being charged to cause a damage in the substrate WF. In one embodiment, the loading unit 100 may include an ionizer (not illustrated) for avoiding the substrate WF from being charged.

As illustrated in FIG. 2, the loading unit 100 includes auxiliary rollers 214 in the proximity of the inlet opening 104 and the outlet opening 108. The auxiliary rollers 214 are arranged at a height approximately the same as that of the conveyance rollers 202. The auxiliary roller 214 supports the substrate WF such that the substrate WF during conveyance does not fall between the unit and another unit. The auxiliary roller 214 is configured to freely rotate without being coupled to a power source.

<Conveyance Unit>

Figure 3:
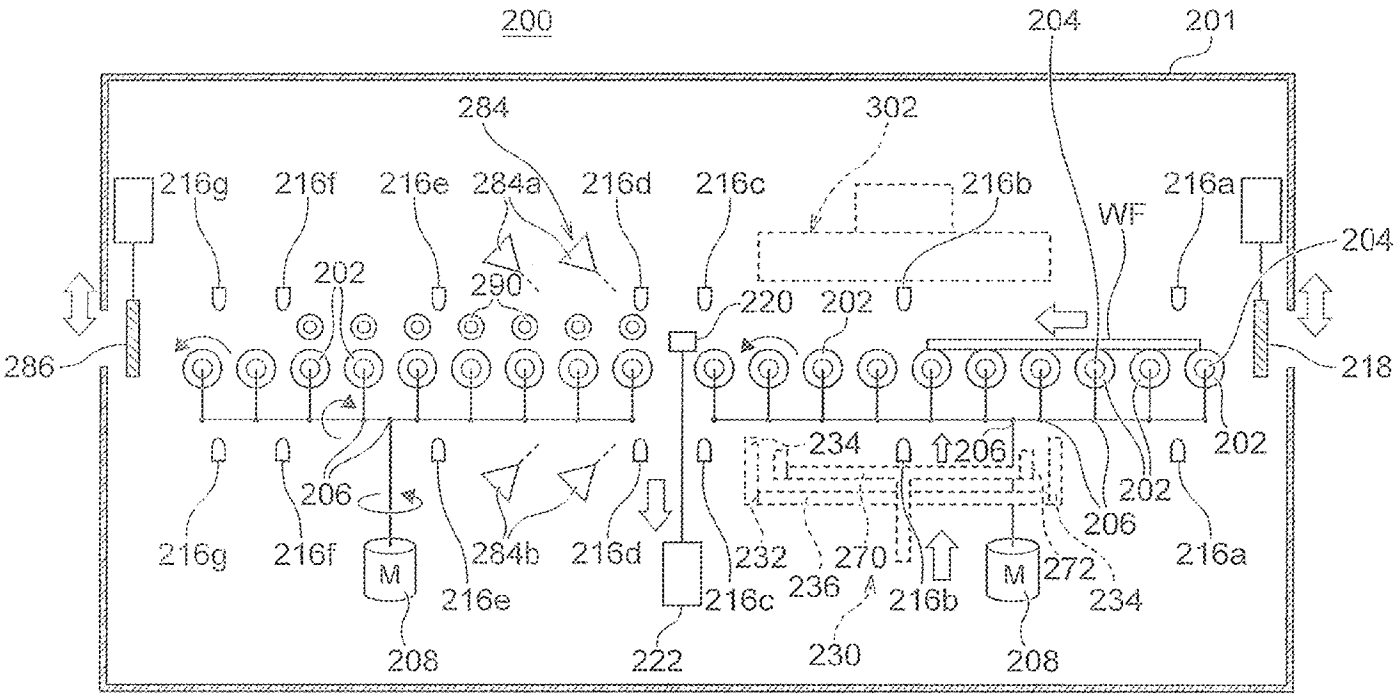
FIG. 3 is a side view schematically illustrating a conveyance unit according to one embodiment.

FIG. 3 is a side view schematically illustrating the conveyance unit 200 according to one embodiment. The substrate processing apparatus 1000 illustrated in FIG. 1 includes the two conveyance units 200A and 200B. Since the two conveyance units 200A and 200B can have identical configurations, the following collectively gives a description as the conveyance unit 200.

The illustrated conveyance unit 200 includes the plurality of conveyance rollers 202 for conveying the substrate WF. Rotating the conveyance rollers 202 ensures conveying the substrate WF on the conveyance rollers 202 in a predetermined direction. The conveyance rollers 202 of the conveyance unit 200 may be formed of a conductive polymer or may be formed of a polymer without a conductive property. The conveyance rollers 202 are mounted on the roller shafts 204, and are driven by a motor 208 via a gear 206. In one embodiment, the motor 208 can be a servo motor. Using the servo motor can control a rotation speed of the roller shafts 204 and the conveyance rollers 202, that is, a conveyance speed of the substrate WF. In one embodiment, the gear 206 can be a magnet gear. Since the magnet gear has a non-contact power transmission mechanism, no microparticles are caused by an abrasion as is the case for a contact type gear, and the maintenance, such as refueling, is not necessary. The illustrated conveyance unit 200 includes a sensor 216 for detecting a presence/absence of the substrate WF at a predetermined position on the conveyance rollers 202. The sensor 216 can be a sensor of any format, for example, can be an optical sensor. In the embodiment illustrated in FIG. 3, seven sensors 216 (216*a* to 216*g*) are disposed in the conveyance unit 200. In one embodiment, corresponding to the detection of the substrate WF by these sensors 216*a* to 216*g*, the operation of the conveyance unit 200 can be controlled. As illustrated in FIG. 3, the conveyance unit 200 includes the openable/closable inlet shutter 218 for receiving the substrate WF in the conveyance unit 200.

As illustrated in FIG. 3, the conveyance unit 200 includes a stopper 220. The stopper 220 is coupled to a stopper moving mechanism 222, and the stopper 220 can enter inside a conveyance path of the substrate WF that moves on the conveyance rollers 202. When the stopper 220 is positioned within the conveyance path of the substrate WF, the substrate WF that moves on the conveyance rollers 202 has a side surface brought into contact with the stopper 220 to ensure stopping the substrate WF on the move at the position of the stopper 220. When the stopper 220 is at a position retreated from the conveyance path of the substrate WF, the substrate WF can move on the conveyance rollers 202. The stop position of the substrate WF by the stopper 220 is a position where a pusher 230 described below can receive the substrate WF on the conveyance rollers 202 (a substrate delivery and receipt position).

As illustrated in FIG. 3, the conveyance unit 200 includes the pusher 230. The pusher 230 is configured to lift the substrate WF on the plurality of conveyance rollers 202 so as to be separated from the plurality of conveyance rollers 202. The pusher 230 is configured to hand over the substrate WF that is held to the conveyance rollers 202 of the conveyance unit 200.

The pusher 230 includes a first stage 232 and a second stage 270. The first stage 232 is a stage for supporting a retainer member 3 of a top ring 302 when the substrate WF is handed over to the top ring 302 described later from the pusher 230. The first stage 232 includes a plurality of support pillars 234 for supporting the retainer member 3 of the top ring 302. The second stage 270 is a stage for receiving the substrate WF on the conveyance rollers 202. The second stage 270 includes a plurality of support pillars 272 for receiving the substrate WF on the conveyance rollers 202. The first stage 232 and the second stage 270 are movable in a height direction with a first elevating mechanism. The second stage 270 is further movable in the height direction with respect to the first stage 232 with a second elevating mechanism. When the first stage 232 and the second stage 270 are elevated by the first elevating mechanism and the second elevating mechanism, a part of the support pillars 234 of the first stage 232 and the support pillars 272 of the second stage 270 passes between the conveyance rollers 202 and the roller shafts 204 and is brought to a position higher than the conveyance rollers 202. The substrate WF conveyed on the conveyance rollers 202 is stopped at the substrate delivery and receipt position by the stopper 220. Afterwards, the first stage 232 and the second stage 270 are elevated by the first elevating mechanism and the substrate WF on the conveyance rollers 202 is lifted up by the support pillars 272 of the second stage 270. Afterwards, while supporting the retainer member 3 of the top ring 302 with the support pillars 234 of the first stage 232, the second stage 270 that holds the substrate WF is elevated with the second elevating mechanism. By vacuum suctioning or the like, the top ring 302 receives and holds the substrate WF on the second stage 270.

In one embodiment, the conveyance unit 200 includes a cleaning unit. As illustrated in FIG. 3, the cleaning unit includes a cleaning nozzle 284. The cleaning nozzle 284 includes an upper cleaning nozzle 284*a* arranged in an upper side of the conveyance rollers 202 and a lower cleaning nozzle 284*b* arranged in a lower side. The upper cleaning nozzle 284*a* and the lower cleaning nozzle 284*b* are coupled to a supply source of a cleaning liquid (not illustrated). The upper cleaning nozzle 284*a* is configured to supply the cleaning liquid to an upper surface of the substrate WF conveyed on the conveyance rollers 202. The lower cleaning nozzle 284*b* is configured to supply the cleaning liquid to a lower surface of the substrate WF conveyed on the conveyance rollers 202. The upper cleaning nozzle 284*a* and the lower cleaning nozzle 284*b* have widths as same as or greater than a width of the substrate WF conveyed on the conveyance rollers 202, and whole surfaces of the substrate WF are configured to be cleaned by the substrate WF being conveyed on the conveyance rollers 202. As illustrated in FIG. 3, the cleaning unit is positioned in a downstream side with respect to the substrate delivery and receipt position of the pusher 230 of the conveyance unit 200.

<Polishing Unit>

Figure 4:
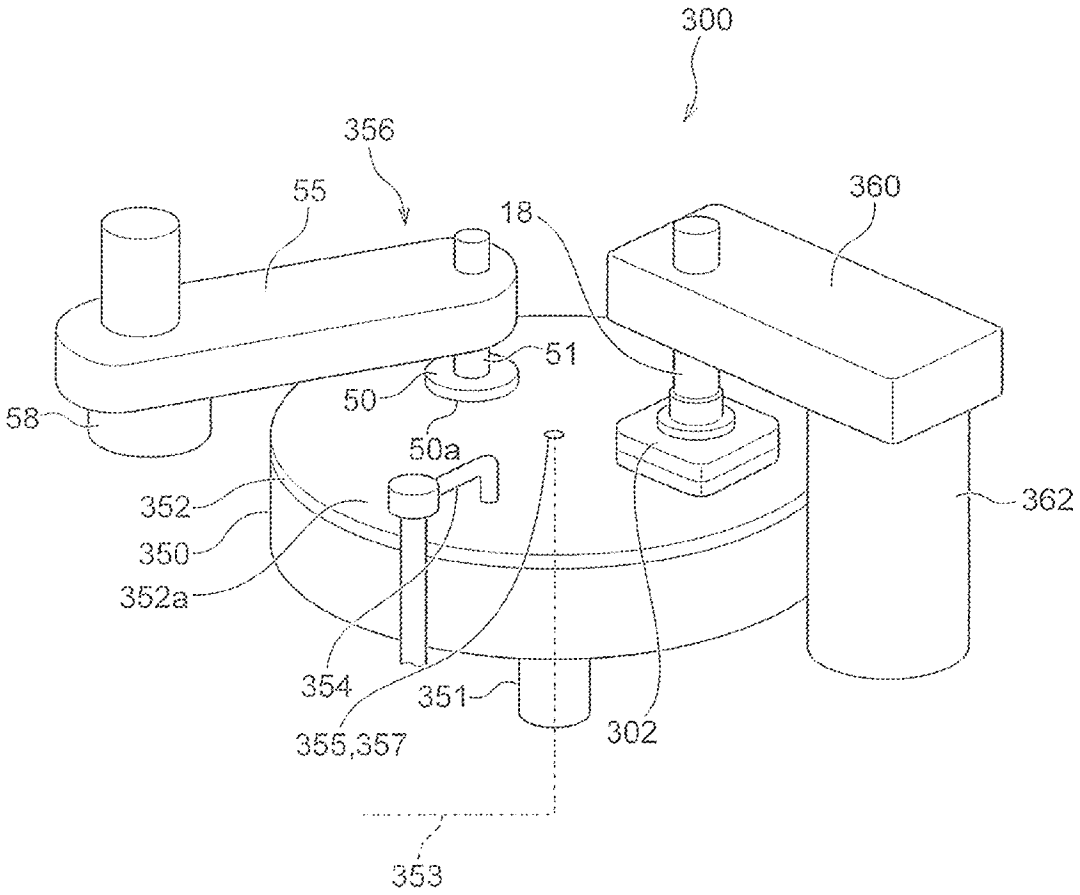
FIG. 4 is a perspective view schematically illustrating a configuration of a polishing unit according to one embodiment.

FIG. 4 is a perspective view schematically illustrating a configuration of the polishing unit 300 according to one embodiment. The substrate processing apparatus 1000 illustrated in FIG. 1 includes the two polishing units 300A and 300B. Since the two polishing units 300A and 300B can have identical configurations, the following collectively gives a description as the polishing unit 300.

As illustrated in FIG. 4, the polishing unit 300 includes a polishing table 350 and the top ring 302 that configures a polishing head that holds the substrate as the polishing object to press onto a polishing surface on the polishing table 350. The polishing table 350 is coupled, via a table shaft 351, to a polishing table rotating motor (not illustrated) arranged below the table shaft 351, and is rotatable about the table shaft 351. The polishing table 350 has an upper surface on which a polishing pad 352 is attached, and the polishing pad 352 has a surface 352*a* that configures a polishing surface that polishes the substrate. In one embodiment, the polishing pad 352 may be attached via a layer for facilitating a separation from the polishing table 350. Such a layer is, for example, a silicone layer and a fluorine-based resin layer, and, for example, one that is disclosed in Japanese Unexamined Patent Application Publication No. 2014-176950 and the like may be used.

A polishing liquid supply nozzle 354 is disposed above the polishing table 350, and this polishing liquid supply nozzle 354 supplies the polishing liquid onto the polishing pad 352 on the polishing table 350. As illustrated in FIG. 4, the polishing table 350 and the table shaft 351 have a passage 353 for supplying the polishing liquid. The passage 353 is communicated with an opening portion 355 on a surface of the polishing table 350. The polishing pad 352 has a through-hole 357 formed at a position corresponding to the opening portion 355 of the polishing table 350. The polishing liquid passing through the passage 353 is supplied to the surface of the polishing pad 352 from the opening portion 355 of the polishing table 350 and the through-hole 357 of the polishing pad 352. Note that the opening portion 355 of the polishing table 350 and the through-hole 357 of the polishing pad 352 may be one or may be plural. The positions of the opening portion 355 of the polishing table 350 and the through-hole 357 of the polishing pad 352 may be anywhere, but are arranged in the proximity of a center of the polishing table 350 in one embodiment.

While it is not illustrated in FIG. 4, in one embodiment, the polishing unit 300 includes an atomizer 358 for injecting a liquid or a mixture fluid of a liquid and a gas toward the polishing pad 352 (see FIG. 1). The liquid injected from the atomizer 358 is, for example, a pure water, and the gas is, for example, a nitrogen gas.

The top ring 302 is coupled to a top ring shaft 18, and this top ring shaft 18 moves up and down with respect to a swing arm 360 by an up-and-down motion mechanism. By this up and down motion of the top ring shaft 18, the whole top ring 302 is moved up and down with respect to the swing arm 360 to determine a position. The top ring shaft 18 rotates by the driving of a top ring rotational motor (not illustrated). The rotation of the top ring shaft 18 rotates the top ring 302 about the top ring shaft 18.

Note that various kinds of polishing pads are available in a market, and there are, for example, SUBA800 ("SUBA" is a registered trademark), IC-1000, and IC-1000/SUBA400 (two-layer cloth) manufactured by Nitta Haas Incorporated, and Surfin xxx-5, Surfin 000, and the like ("Surfin" is a registered trademark) manufactured by FUJIMI INCORPORATED. SUBA800, Surfin xxx-5, and Surfin 000 are nonwoven fabrics made of fibers hardened with a urethane resin, and IC-1000 is a hard foamed-polyurethane (single layer). The foamed polyurethane is porous (porous form), and has multiple fine depressions or pores on its surface.

The top ring 302 can hold a square shaped substrate on its lower surface. The swing arm 360 is configured to be turnable about a spindle 362. The top ring 302 is movable between the substrate delivery and receipt position and an upper side of the polishing table 350 of the above-described conveyance unit 200 by the turn of the swing arm 360. Moving the top ring shaft 18 down moves the top ring 302 down to ensure pressing the substrate onto the surface (polishing surface) 352*a* of the polishing pad 352. At this time, the top ring 302 and the polishing table 350 are each rotated, and the polishing liquid is supplied onto the polishing pad 352 from the polishing liquid supply nozzle 354 disposed above the polishing table 350 and/or from the opening portion 355 disposed on the polishing table 350. Thus, the surface of the substrate can be polished by pressing the substrate onto the polishing surface 352*a* of the polishing pad 352. During the polishing of the substrate WF, the swing arm 360 may be fixed or swung such that the top ring 302 passes through the center of the polishing pad 352 (such that the through-hole 357 of the polishing pad 352 is covered).

The polishing unit 300 according to one embodiment includes a dressing unit 356 that dresses the polishing surface 352*a* of the polishing pad 352. This dressing unit 356 includes a dresser 50 that is brought into sliding contact with the polishing surface 352*a*, a dresser shaft 51 to which the dresser 50 is coupled, and a swing arm 55 that rotatably supports the dresser shaft 51. The dresser 50 has a lower portion configured of a dressing member 50*a*, and this dressing member 50*a* has a lower surface on which needle shaped diamond particles are attached.

The swing arm 55 is configured to turn about a spindle 58 by being driven by a motor (not illustrated). The dresser shaft 51 rotates by the driving of a motor (not illustrated). This rotation of the dresser shaft 51 causes the dresser 50 to rotate about the dresser shaft 51. The dresser shaft 51 is configured to move up and down, and via the dresser shaft 51, the dresser 50 can be moved up and down to press the dresser 50 onto the polishing surface 352*a* of the polishing pad 352 with a predetermined pressing force.

The dressing of the polishing surface 352*a* of the polishing pad 352 is performed as follows. The dresser 50 is pressed onto the polishing surface 352*a* by an air cylinder or the like, and simultaneously with this, a pure water is supplied to the polishing surface 352*a* from a pure water supplying nozzle (not illustrated). In this state, the dresser 50 rotates about the dresser shaft 51, and the lower surface of the dressing member 50*a* (the diamond particles) is brought into sliding contact with the polishing surface 352*a*. Thus, the polishing pad 352 is scraped by the dresser 50 to dress the polishing surface 352*a*.

Figure 5:
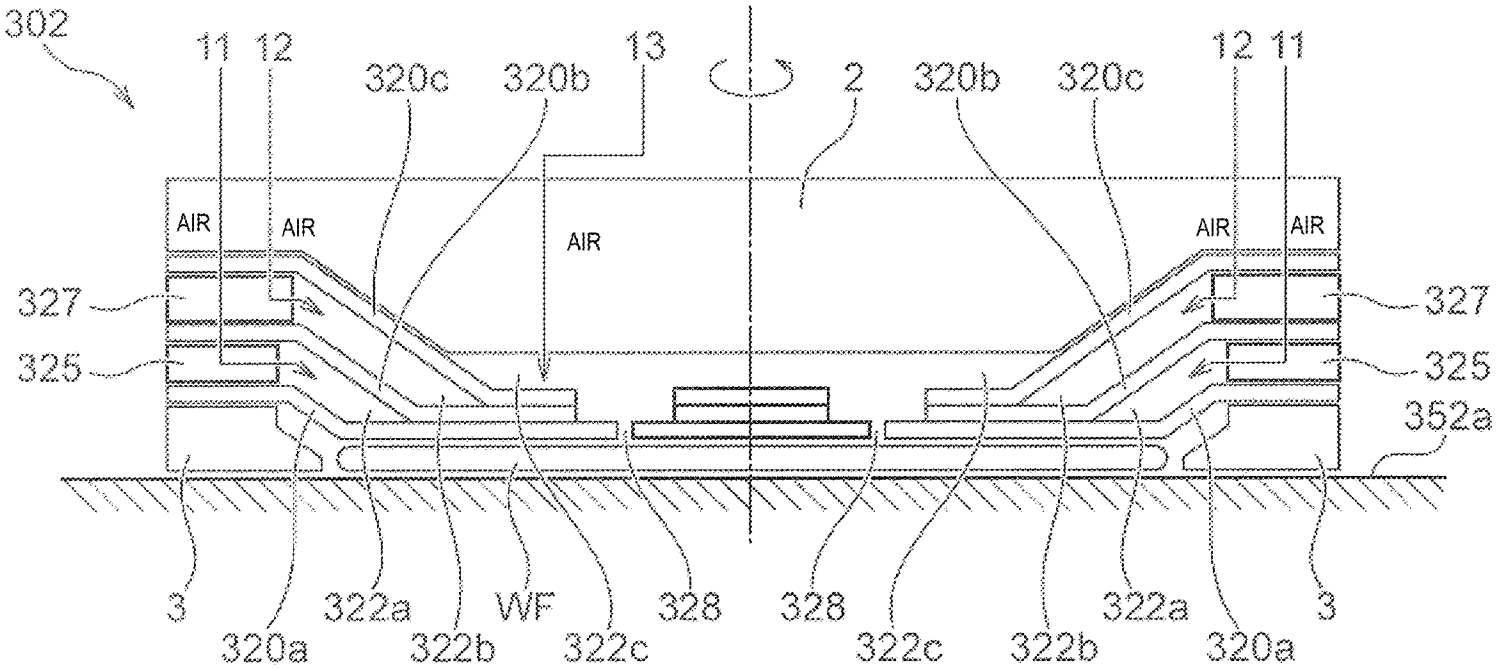
FIG. 5 is a schematic cross-sectional view of a top ring that presses a substrate onto a polishing surface on a polishing pad by holding a substrate as a polishing object according to one embodiment.
Figure 6:
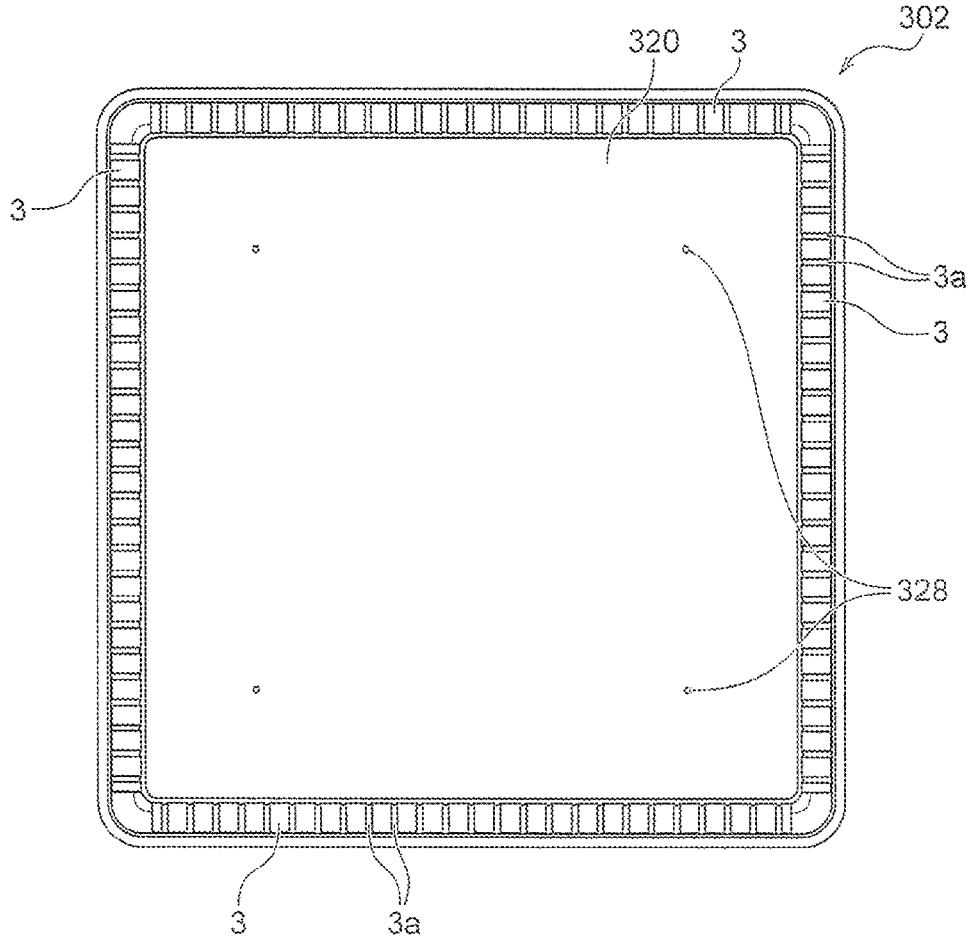
FIG. 6 is a drawing viewing the top ring from a side of a polishing table according to one embodiment.

Next, the top ring 302 in the polishing unit 300 according to one embodiment will be described. FIG. 5 is a schematic cross-sectional view of the top ring 302 that presses the substrate onto the polishing surface on the polishing pad by holding the substrate as the polishing object according to one embodiment. In FIG. 5, only main configuration members configuring the top ring 302 are schematically illustrated. FIG. 6 is a drawing viewing the top ring 302 from a side of the polishing table 350 according to one embodiment.

As illustrated in FIG. 5, the top ring 302 includes a top ring main body 2 that presses the substrate WF onto the polishing surface 352*a* and the retainer member 3 for preventing the substrate held by the top ring main body 2 from falling out from the top ring main body 2 during the polishing. The retainer member 3 may be configured to directly press the polishing surface 352*a*. The retainer member 3 may be configured not to be in contact with the polishing surface 352*a*. The top ring main body 2 is coupled to the top ring shaft 18, and is configured to be rotatable with the rotation of the top ring shaft 18. The top ring main body 2 may be configured by combining a plurality of members. The top ring main body 2 is formed of a flat plate-shaped member in a schematically square shape, and the retainer member 3 is installed on an outer peripheral portion of the top ring main body 2.

In one embodiment, the retainer member 3 is a member in an elongated rectangular plate shape as illustrated in FIG. 6. In the embodiment according to FIG. 6, the retainer member 3 has four plate-shaped members disposed on outer peripheral portions of respective sides of the square-shaped top ring main body 2. In one embodiment, the retainer member 3 has a plurality of grooves 3*a* as illustrated in FIG. 6. The retainer member 3 illustrated in FIG. 6 has the grooves 3*a* formed to extend outward from an inside of the top ring 302. Note that, in one embodiment, the retainer member 3 without the grooves 3*a* may be employed. The top ring main body 2 is formed of a metal, such as stainless steel (SUS), and a resin, such as an engineering plastic (e.g. PEEK). The top ring main body 2 has a lower surface on which an elastic film (membrane) that is brought into contact with a back surface of the substrate is mounted. Note that the top ring main body 2 may be configured by combining a plurality of members.

In one embodiment, the elastic film (membrane) is a laminated membrane 320 on which a plurality of sheet materials as illustrated are laminated. In this disclosure, the "sheet material" means a material formed of a two-dimensional structure in a natural state without any addition of force, excluding a thickness of the material. That is, the sheet material does not have a structural or geometric feature in a thickness direction in the natural state without any addition of force. In one embodiment, each of the sheet materials that configures the laminated membrane 320 is formed of a rubber material high in strength and durability, such as ethylene propylene rubber (EPDM), polyurethane rubber, and silicone rubber.

As illustrated in FIG. 5, in the laminated membrane 320, parts of neighboring sheet materials are mutually adhered. Therefore, the laminated membrane 320 includes a plurality of pressure chambers. In the embodiment illustrated in FIG. 5, the laminated membrane 320 is formed of three sheet materials 320*a*, 320*b*, and 320*c*, and includes a first pressure chamber 322*a*, a second pressure chamber 322*b*, and a third pressure chamber 322*c*. In the embodiment illustrated in FIG. 5, the three sheet materials are described as a first sheet material 320*a*, a second sheet material 320*b*, and a third sheet material 320*c* from a side of the substrate. In the embodiment illustrated in FIG. 5, the first sheet material 320*a* has an end portion held by the retainer member 3 and a first membrane holder 325. The second sheet material 320*b* has an end portion held by the first membrane holder 325 and a second membrane holder 327. The third sheet material 320*c* has an end portion held by the second membrane holder 327 and the top ring main body 2. As illustrated, the first pressure chamber 322*a* is defined between the first sheet material 320*a* and the second sheet material 320*b*, the second pressure chamber 322*b* is defined between the second sheet material 320*b* and the third sheet material 320*c*, and the third pressure chamber 322*c* is defined between the third sheet material 320*c* and the top ring main body 2. In the embodiment illustrated in FIG. 5, a flow passage 11 is coupled to the first pressure chamber 322*a*, a flow passage 12 is coupled to the second pressure chamber 322*b*, and a flow passage 13 is coupled to the third pressure chamber 322*c*. Each of the flow passages 11, 12, and 13 is connectable to a fluid source (for example, highly compressed air or nitrogen) and/or a vacuum source, and pressures of the respective pressure chambers 322*a*, 322*b*, and 322*c* can be respectively and independently controlled.

In one embodiment, the laminated membrane 320 can have vacuum suction holes 328 as illustrated in FIG. 5. The vacuum suction hole 328 is used for vacuum suctioning the substrate WF under the laminated membrane 320. The vacuum suction hole 328 can also be used to remove the substrate from the top ring 302. For example, supplying a fluid (for example, air or nitrogen) from the vacuum suction hole 328 can remove the substrate WF held under the laminated membrane 320.

Figure 7:
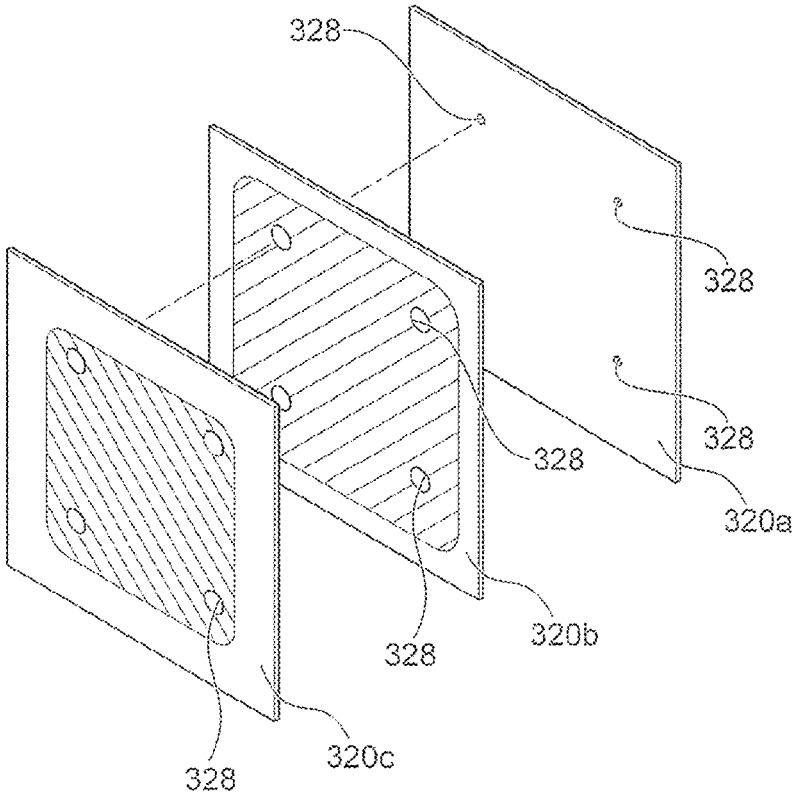
FIG. 7 is a perspective view schematically illustrating bonded regions of three sheet materials of a laminated membrane according to one embodiment.

FIG. 7 is a perspective view illustrating bonded regions of the three sheet materials 320*a*, 320*b*, and 320*c* of the laminated membrane 320 according to one embodiment. In the embodiment illustrated in FIG. 7, the first sheet material 320*a* is disposed on the lowermost contacting the substrate, the second sheet material 320*b* is disposed on the first sheet material 320*a*, and the third sheet material 320*c* is disposed on the uppermost. In the illustrated embodiment, the hatched region in the second sheet material 320*b* and the first sheet material 320*a* are bonded. The hatched region in the third sheet material 320*c* and the second sheet material 320*b* are bonded. As illustrated in FIG. 7, four vacuum suction holes 328 are formed on the first sheet material 320*a*, and further, the respective vacuum suction holes 328 are formed at corresponding positions on the second sheet material 320*b* and the third sheet material 320*c*. As illustrated in FIG. 7, bonding the three sheet materials 320*a*, 320*b*, and 320*c* for lamination ensures forming the three pressure chambers 322*a*, 322*b*, and 322*c* illustrated in FIG. 5. Note that the configuration of the laminated membrane 320 illustrated in FIGS. 5 and 7 is one example, and the number of sheet materials and the bonded region are not limited.

Figure 8:
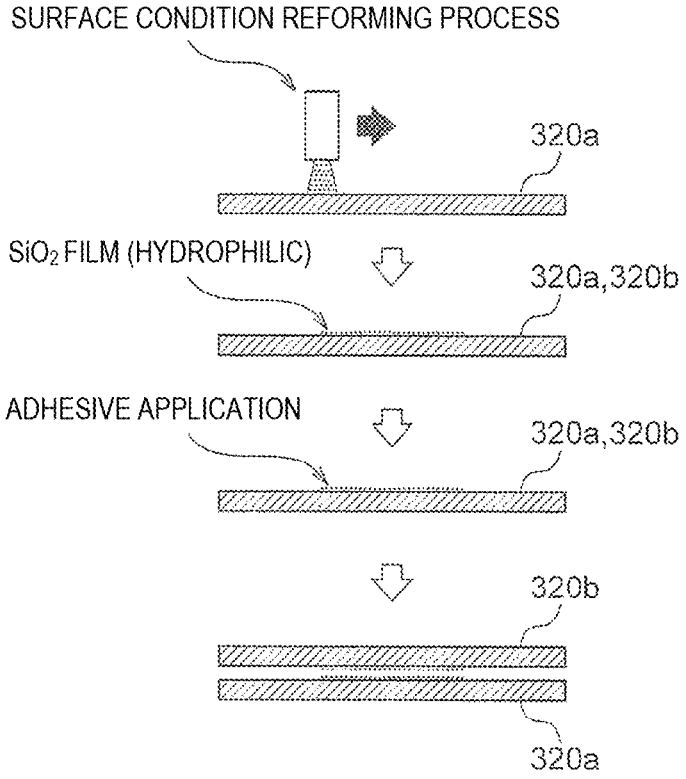
FIG. 8 is a drawing for describing a method for manufacturing the laminated membrane according to one embodiment.
Figure 9:
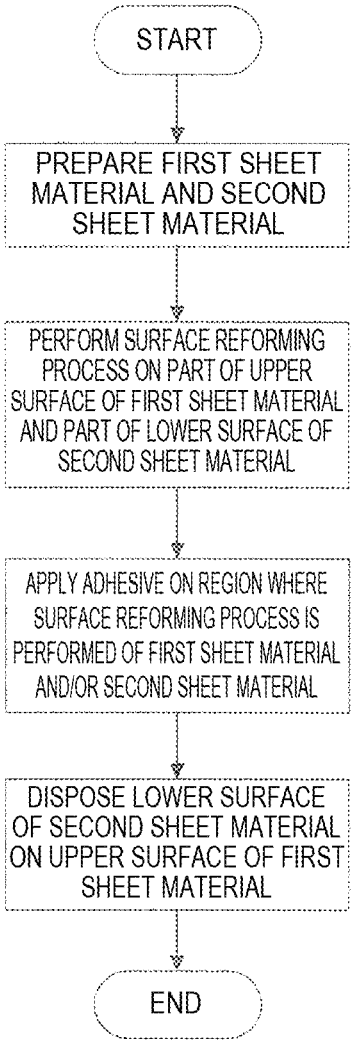
FIG. 9 is a flowchart illustrating a method for manufacturing the laminated membrane according to one embodiment.

FIG. 8 is a drawing for describing a method for manufacturing the laminated membrane 320 according to one embodiment. FIG. 9 is a flowchart illustrating the method for manufacturing the laminated membrane 320 according to one embodiment. First, sheet materials to be laminated are prepared. In the illustrated example, the first sheet material 320*a* and the second sheet material 320*b* are prepared. The first sheet material 320*a* can be the sheet material disposed on the lowermost contacting the substrate. The first sheet material 320*a* and the second sheet material 320*b* can, for example, be a vulcanized rubber material. In one example, silicone rubber can be used as the first sheet material 320*a* and the second sheet material 320*b*. Note that the second sheet material 320*b* may be a material identical to that of the first sheet material 320*a*, or may be a different material.

Next, a part of an upper surface of the first sheet material 320*a* and a part of a lower surface of the second sheet material 320*b* undergo a surface reforming process. The surface reforming process is performed on the regions to be bonded of the first sheet material 320*a* and the second sheet material 320*b*. Generally, a rubber material is difficult to bond with an adhesive, and therefore, the surface of the sheet material is reformed so as to be easily bonded with the adhesive. The surface reforming process can, for example, be performed by forming a silicon oxide film high in hydrophilicity on the surfaces of the first sheet material 320*a* and the second sheet material 320*b*. As the surface reforming process, for example, Flame Bond (registered trademark) can be applied.

Next, an adhesive is applied on the region on which the surface reforming process has been performed of the first sheet material 320*a* and/or the region on which the surface reforming process has been performed of the second sheet material 320*b*. The adhesive is preferred to be an elastic adhesive so as to be able to maintain the elasticity of the sheet materials.

Next, the second sheet material 320*b* is disposed on the first sheet material 320*a*, and the first sheet material 320*a* and the second sheet material 320*b* are bonded. While in the illustrated example, the method that bonds the first sheet material 320*a* and the second sheet material 320*b* is described, more sheet materials can be laminated with the similar method. In such procedures, any number of a plurality of the sheet materials are bonded and laminated to form the laminated membrane 320. In the above-described method, any regions of the neighboring sheet materials can be bonded. In the method according to the above-described embodiment, only the sheet materials having a two-dimensional structure without having a complicated three-dimensional structure are used, and therefore, the laminated membrane 320 including a plurality of pressure chambers 322 can be formed without using a mold having a complicated shape.

Figure 10:
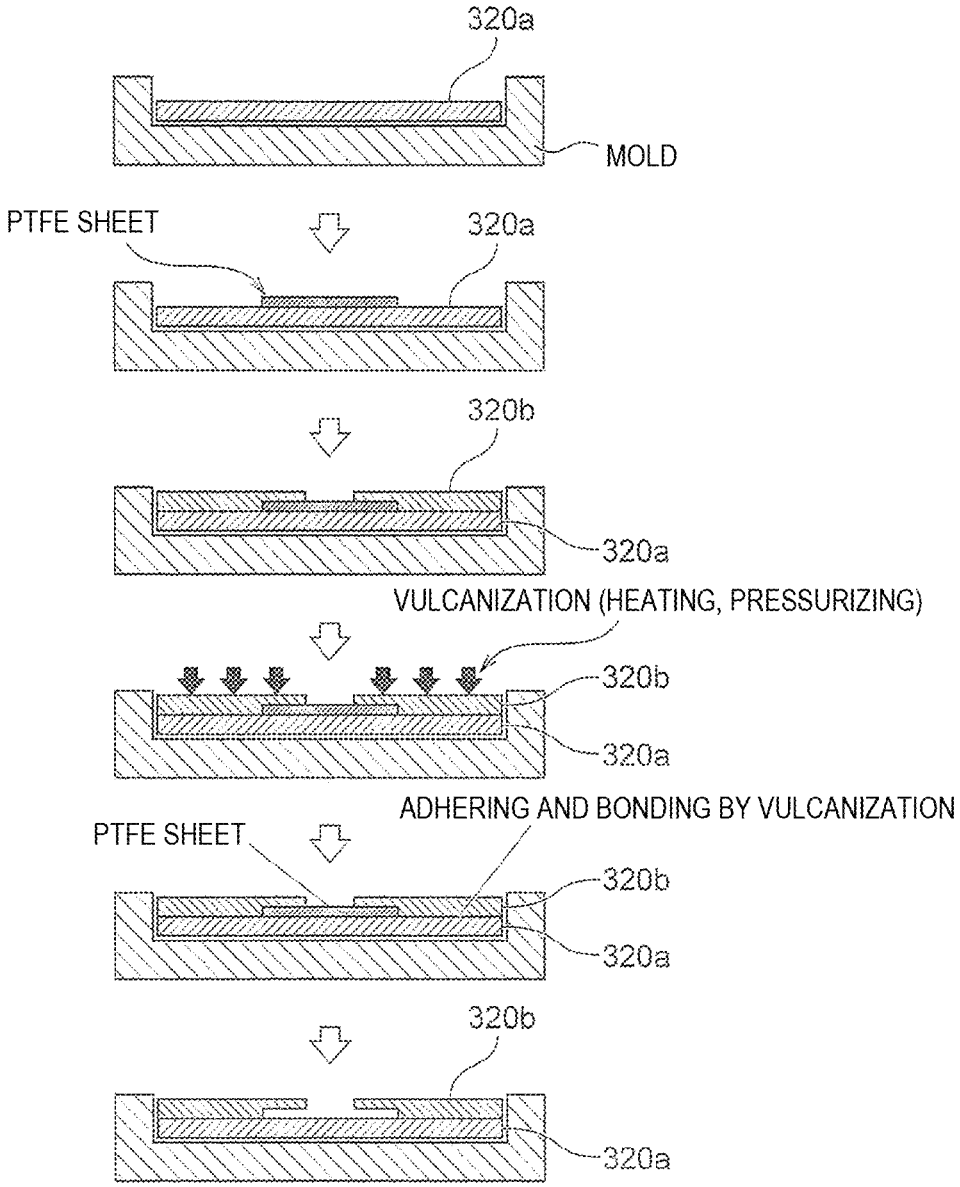
FIG. 10 is a drawing for describing a method for manufacturing the laminated membrane according to one embodiment.
Figure 11:
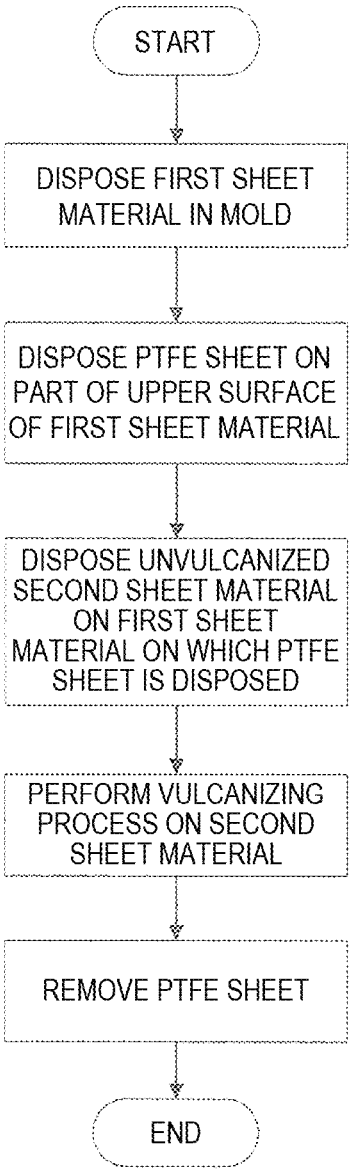
FIG. 11 is a flowchart illustrating a method for manufacturing the laminated membrane according to one embodiment.

FIG. 10 is a drawing for describing a method for manufacturing the laminated membrane 320 according to one embodiment. FIG. 11 is a flowchart illustrating the method for manufacturing the laminated membrane 320 according to the one embodiment. First, the first sheet material 320*a* is disposed in a mold. This mold is only necessary to be in a shape where the first sheet material 320*a* and the second sheet material 320*b* laminated thereafter can be stably disposed, and therefore, the mold can be in a simple shape. For example, the mold can be a mold that defines a depressed portion having a flat bottom surface that fits an outer shape of the first sheet material 320*a*. The first sheet material 320*a* can be a sheet material disposed on the lowermost contacting the substrate. The first sheet material 320*a* can be, for example, a vulcanized rubber material. In one example, silicone rubber can be used as the first sheet material 320*a*.

Next, a sheet made of fluororesin is disposed on a part of the upper surface of the first sheet material 320*a*. The sheet made of fluororesin can be, for example, a sheet of polytetrafluoroethylene (a PTFE sheet). The PTFE sheet is disposed on a region that is not bonded on the second sheet material 320*b*. Next, the second sheet material 320*b* is disposed on the first sheet material 320*a*. In one embodiment, the second sheet material 320*b* can be an unvulcanized rubber material. Afterwards, a vulcanizing process is performed on the second sheet material 320*b*. The vulcanizing process can, for example, be performed by pressurizing and heating the second sheet material 320*b*. Performing the vulcanizing process ensures bonding the first sheet material 320*a* and the second sheet material 320*b* at a region other than the region on which the PTFE sheet is disposed. After performing the vulcanizing process, the PTFE sheet is removed.

In the method described in FIG. 10 and FIG. 11, the laminated membrane 320 can be formed by laminating any number of the sheet materials. In the above-described method, any regions of the neighboring sheet materials can be bonded. For example, any regions of any number of the sheet materials can be bonded by repeating disposing the PTFE sheet on the second sheet material 320*b* undergone the vulcanizing process, disposing the sheet material made of an unvulcanized rubber material on the PTFE sheet, performing the vulcanizing process, and removing the PTFE sheet. In the method according to the above-described embodiment, only the sheet materials having a two-dimensional structure without having a complicated three-dimensional structure are used, and therefore, the laminated membrane 320 including the plurality of pressure chambers 322 can be formed only by using a simple shaped mold, without using a mold having a complicated shape.

Figure 12:
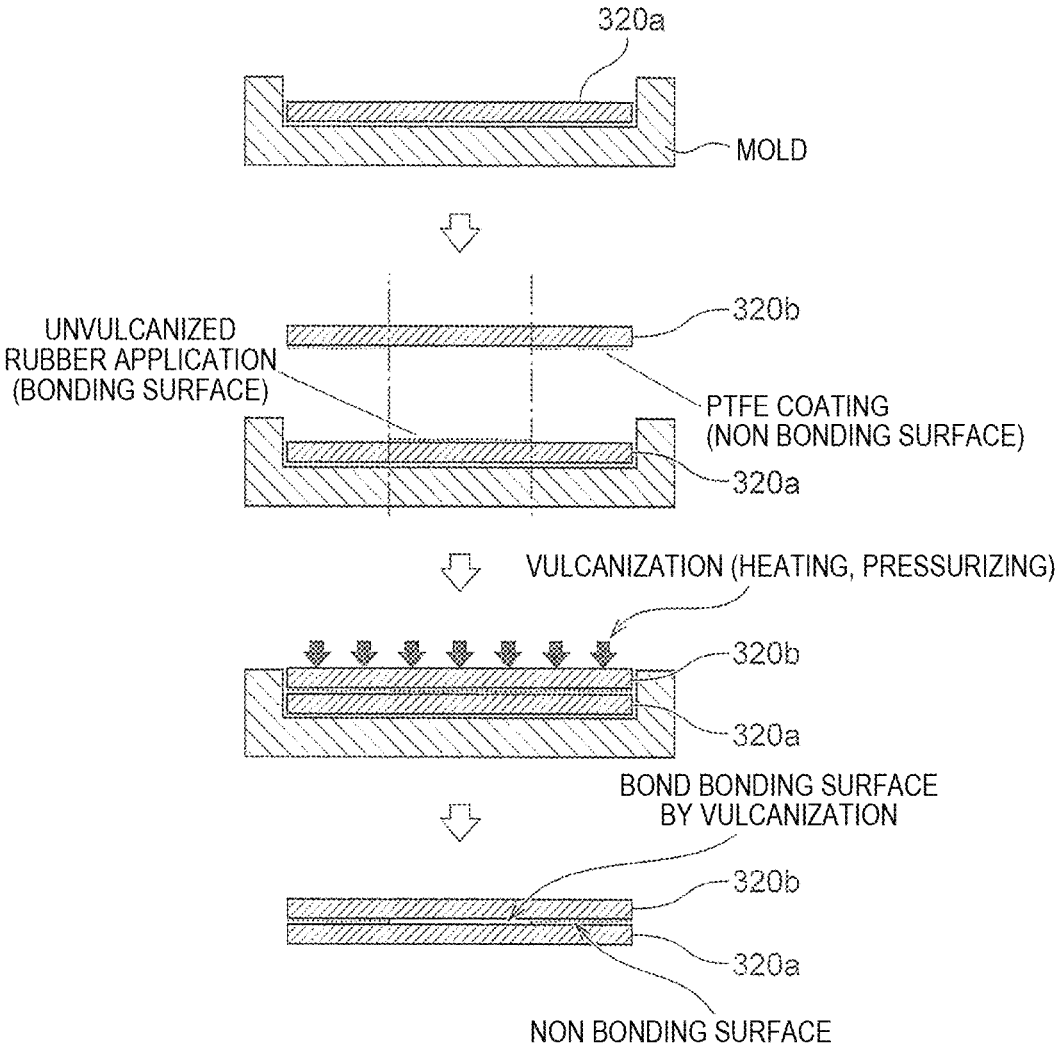
FIG. 12 is a drawing for describing a method for manufacturing the laminated membrane according to one embodiment.
Figure 13:
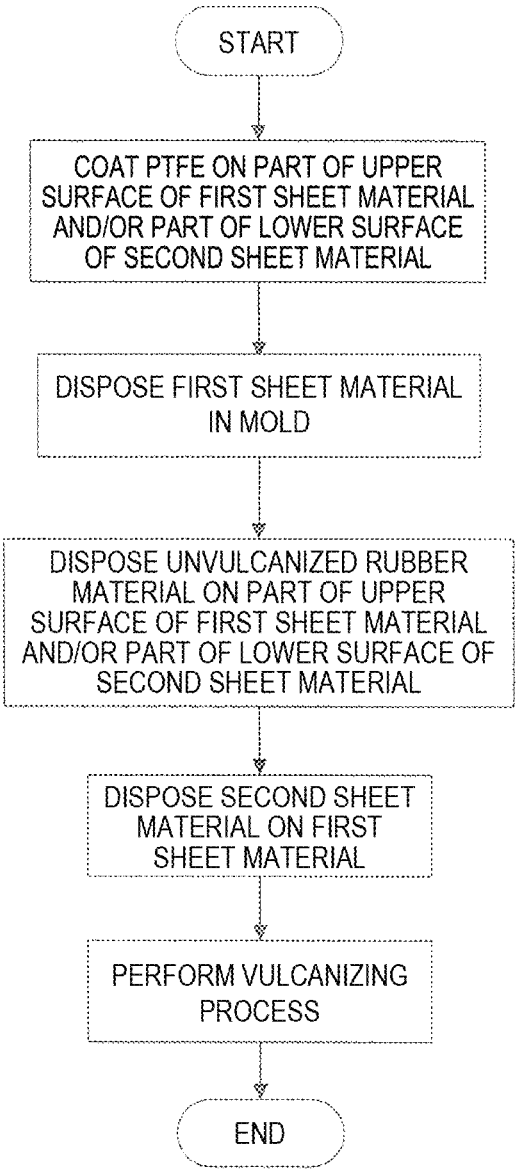
FIG. 13 is a flowchart illustrating a method for manufacturing the laminated membrane according to one embodiment.

FIG. 12 is a drawing for describing a method for manufacturing the laminated membrane 320 according to one embodiment. FIG. 13 is a flowchart illustrating the method for manufacturing the laminated membrane 320 according to the one embodiment. First, the first sheet material 320*a* and the second sheet material 320*b* are prepared. The first sheet material 320*a* can be a sheet material disposed on the lowermost contacting the substrate. The first sheet material 320*a* and the second sheet material 320*b* can be, for example, a vulcanized rubber material. In one example, silicone rubber can be used as the first sheet material 320*a* and the second sheet material 320*b*.

Next, a part of the upper surface of the first sheet material 320*a* and/or a part of the lower surface of the second sheet material 320*b* are coated with fluororesin. The fluororesin coating can be, for example, a PTFE coating. The PTFE coating can be applied on a region that is not bonded to the second sheet material 320*b* on the first sheet material 320*a*. The PTFE coating can be applied on a region not bonded to the first sheet material 320*a* on the second sheet material 320*b*.

Next, the first sheet material 320*a* is disposed in the mold. This mold is only necessary to be in a shape where the first sheet material 320*a* and the second sheet material 320*b* laminated thereafter can be stably disposed, and therefore, the mold can be in a simple shape. For example, the mold can be a mold that defines a depressed portion having a flat bottom surface that fits an outer shape of the first sheet material 320*a*.

Next, an unvulcanized rubber material is disposed on a part of the upper surface of the first sheet material 320*a* and/or a part of the lower surface of the second sheet material 320*b*. The unvulcanized rubber material can be disposed in regions where the first sheet material 320*a* and the second sheet material 320*b* are bonded. Afterwards, the second sheet material 320*b* is disposed on the first sheet material 320*a* such that the lower surface of the second sheet material 320*b* are in contact with the upper surface of the first sheet material 320*a*. Next, performing the vulcanizing process bonds the first sheet material 320*a* and the second sheet material 320*b*. The vulcanizing process can, for example, be performed by pressurizing and heating on the second sheet material 320*b*. Performing the vulcanizing process ensures bonding the first sheet material 320*a* and the second sheet material 320*b* in a region applied with the unvulcanized rubber other than the region coated with PTFE.

In the method described in FIG. 12 and FIG. 13, the laminated membrane 320 can be formed by laminating any number of the sheet materials. In the above-described method, any regions of the neighboring sheet materials can be bonded. In the method according to the above-described embodiment, only the sheet materials having a two-dimensional structure without having a complicated three-dimensional structure are used, and therefore, the laminated membrane 320 including the plurality of pressure chambers 322 can be formed only by using a simple shaped mold, without using a mold having a complicated shape. While in FIG. 12 and FIG. 13, the case where two sheet materials are bonded has been described, three or more sheet materials may be laminated by disposing an unvulcanized rubber material in a region where the neighboring sheet materials are bonded, and applying a PTFE coating in a region that is not bonded in one embodiment. In such a case, performing the vulcanizing process after laminating all the three or more sheet materials ensures bonding all the sheet materials with one vulcanizing process.

Figure 14:
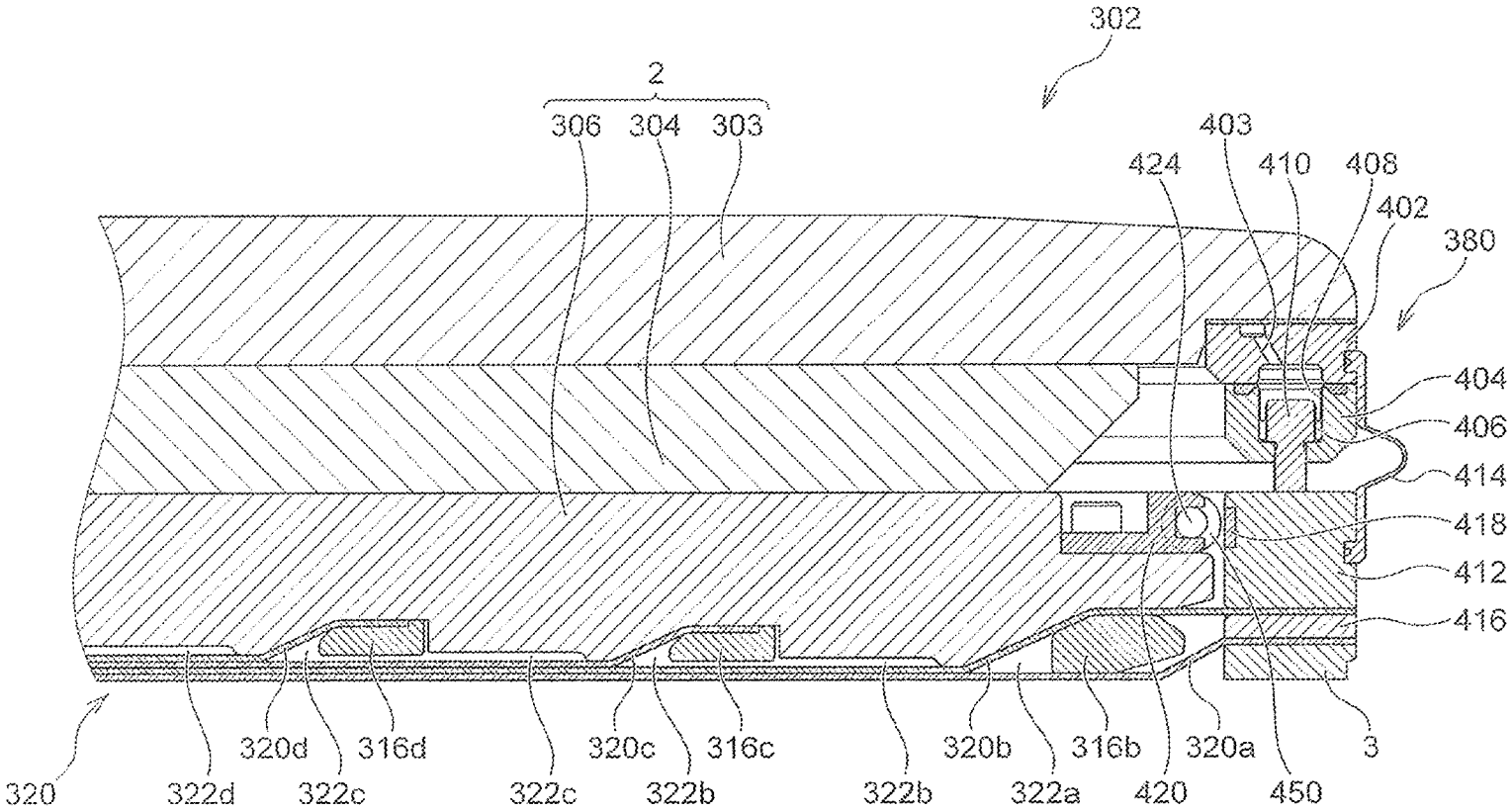
FIG. 14 is a cross-sectional view illustrating a part of the top ring including the laminated membrane according to one embodiment.

FIG. 14 is a cross-sectional view illustrating a part of the top ring 302 including the laminated membrane 320 according to one embodiment. In the embodiment illustrated in FIG. 14, the top ring 302 includes the top ring main body 2 and the retainer portion 380. The top ring main body 2 has an approximately square shape as a whole (see FIG. 4), and has a square plate-shaped upper member 303, an intermediate member 304 installed on a lower surface of the upper member 303, and a lower member 306 installed on a lower surface of the intermediate member 304. The retainer portion 380 is installed on an outer peripheral portion of the upper member 303. The upper member 303 is coupled to the top ring shaft 18 (FIG. 4) with a bolt or the like. The intermediate member 304 is coupled to the upper member 303 with a bolt or the like. The lower member 306 is coupled to the upper member 303 with a bolt or the like. The upper member 303, the intermediate member 304, and the lower member 306 can be formed of a metallic material and a plastic material. In one embodiment, the upper member 303 is formed of stainless steel (SUS), and the intermediate member 304 and the lower member 306 are formed of the plastic material.

As illustrated in FIG. 14, on lower surface of the lower member 306, the laminated membrane 320 that is brought into contact with the back surface of the substrate WF is installed. This laminated membrane 320 is formed of the sheet materials as described above. In the embodiment illustrated in FIG. 14, the laminated membrane 320 is formed of four sheet materials 320*a*, 320*b*, 320*c*, and 320*d*. As illustrated, the first sheet material 320*a* on the lowermost contacting the substrate is held by being sandwiched between the retainer member 3 and a retainer guide 416. The second sheet material 320*b* disposed on the first sheet material 320*a* is held by being sandwiched between a holder 316*b* and the lower member 306 and also sandwiched between the retainer guide 416 and a retainer support guide 412. The third sheet material 320*c* disposed on the second sheet material 320*b* is held by being sandwiched between a holder 316*c* and the lower member 306. A fourth sheet material 320*d* disposed on the third sheet material 320*c* is held by being sandwiched between a holder 316*d* and the lower member 306. In the embodiment illustrated in FIG. 14, the first pressure chamber 322*a* is defined between the first sheet material 320*a* and the second sheet material 320*b*, the second pressure chamber 322*b* is defined between the second sheet material 320*b* and the third sheet material 320*c*, the third pressure chamber 322*c* is defined between the third sheet material 320*c* and the fourth sheet material 320*d*, and a fourth pressure chamber 322*d* is defined between the fourth sheet material 320*d* and the lower member 306. The sheet materials 320*a*, 320*b*, 320*c*, and 320*d* are sandwiched between each of the members, such as a holder, and serve as portions to seal a fluid supplied to each of the pressure chambers 322*a*, 322*b*, 322*c*, and 322*d*. The first pressure chamber 322*a*, the second pressure chamber 322*b*, the third pressure chamber 322*c*, and the fourth pressure chamber 322*d* are communicated with respective flow passages (not illustrated). The respective flow passages can be coupled to fluid sources (for example, highly compressed air or nitrogen) and/or vacuum sources, and can respectively and independently control the respective pressure chambers 322*a* to 322*d*. Therefore, when polishing the substrate WF, contact pressures to the polishing pad 352 can be controlled for each of area regions of the substrate WF.

In the embodiment illustrated in FIG. 14, the first sheet material 320*a* to the fourth sheet material 320*d* are secured in an inner side or in a center side of the top ring main body 2 with approaching from the first sheet material 320*a* in a side close to the substrate WF (the lower side in FIG. 14) to the fourth sheet material 320*d* in a side far from the substrate WF (the upper side in FIG. 14). The sheet materials have dimensions that decrease with approaching from the first sheet material 320*a* in the side close to the substrate WF to the fourth sheet material 320*d* in the side far from the substrate WF.

In the embodiment illustrated in FIG. 14, the retainer portion 380 is disposed on the outer peripheral portion of the upper member 303. As illustrated, the outer peripheral portion of the upper member 303 has a lower surface to which an upper housing 402 is coupled. In one embodiment, the upper housing 402 can be secured to the upper member 303 with a bolt or the like via a seal packing or the like. The upper housing 402 has a lower surface on which a lower housing 404 is disposed. In one embodiment, the upper housing 402 and the lower housing 404 are square circular members as a whole, and can be formed of polyphenylene sulfide (PPS) resin. The lower housing 404 internally defines a cylinder-shaped cylinder 406. In the cylinder 406, a diaphragm 408 is disposed. In one embodiment, the diaphragm 408 is formed of a rubber material. The diaphragm 408 is secured by being sandwiched between the upper housing 402 and the lower housing 404. The cylinder 406 has an internal space partitioned into an upper space and a lower space by the diaphragm 408. In the diaphragm 408 of the lower housing 404, a piston 410 is disposed. The piston 410 has one end in contact with a lower surface of the diaphragm 408. The piston 410 has the other end in contact with the retainer support guide 412 by sticking out from a lower side of the lower housing 404. In one embodiment, the piston 410 can be formed of PPS resin.

The upper housing 402 has a passage 403. The passage 403 is coupled to a fluid source (not illustrated). A pressurized fluid (for example, air or nitrogen) can be supplied into the upper space of the cylinder 406 of the lower housing 404 from the fluid source through the passage 403. When the fluid is supplied into the upper space of the cylinder 406, the diaphragm 408 bulges downward to move the piston 410 downward. The piston 410 moving downward ensures moving the retainer support guide 412 downward.

In one embodiment, as illustrated in FIG. 14, a band 414 is installed from an outer side surface of the upper housing 402 to an outer side surface of the retainer support guide 412. The band 414 allows a displacement of the retainer support guide 412 with respect to the lower housing 404, and prevents ingress of the polishing liquid and the like into the space between the lower housing 404 and the retainer support guide 412.

As illustrated, the retainer support guide 412 has a lower surface on which the retainer guide 416 is installed. In one embodiment, as illustrated, the end portion of the second sheet material 320*b* is held between the retainer support guide 412 and the retainer guide 416. As illustrated, the retainer guide 416 has a lower surface on which the retainer member 3 is installed. The retainer support guide 412, the retainer guide 416, and the retainer member 3 can be secured with a bolt or the like. The retainer support guide 412 and the retainer guide 416 are square circular members that fit an entire shape of the top ring 302 as a whole. In one embodiment, the retainer support guide 412 and the retainer guide 416 are formed of stainless steel (SUS), and the retainer member 3 is formed of PPS resin, polyvinyl chloride resin, or the like. As described above, the retainer support guide 412 is moved downward by the piston 410 in the lower housing 404, and thus, the retainer member 3 is moved downward.

In one embodiment, the top ring 302 includes a retainer guiding device that guides the retainer member 3 such that the retainer member 3 can displace in an up and down direction, and supports the retainer member 3 such that the retainer member 3 is inhibited from displacing in a lateral direction. In one embodiment, as illustrated in FIG. 14, the retainer support guide 412, the retainer guide 416, and the retainer member 3 are supported and guided by a support roller 450 to be movable in the up and down direction. As illustrated, the retainer support guide 412 has an inner side surface where a support pad 418 is secured. As illustrated, in a state where the support pad 418 secured to the retainer support guide 412 is in contact with and supported by the support roller 450, the retainer support guide 412, the retainer guide 416, and the retainer member 3 move in the up and down direction. Note that, in one embodiment, between the support pad 418 secured to the retainer support guide 412 and the support roller 450, a slight clearance may be configured be provided. In one embodiment, the support pad 418 can be formed of PPS resin, vinyl chloride resin, or PEEK resin.

In one embodiment, the lower housing 404 has a circumferential direction (a direction perpendicular to the paper surface) in which a plurality of the cylinders 406 are formed, and each of the cylinders 406 includes the diaphragm 408 and the piston 410. Using the cylinders 406, the diaphragms 408, and the pistons 410 in the identical shapes ensures reducing a cost for manufacturing them. For example, even when the case where the top ring main body 2 having a different dimension is manufactured, the diaphragm 408 and the piston 410, which are the same components, are usable, and a design can be employed to change the used number depending on a size of the top ring main body 2.

As illustrated in FIG. 14, a retainer support frame 420 is secured to the lower member 306 of the top ring main body 2. The retainer support frame 420 is secured to the lower member 306 with a bolt or the like.

In one embodiment, a plurality of the support rollers 450 are disposed along each of sides of the square circular retainer portion 380. For example, three support rollers 450 are disposed on each of the sides of the square retainer support frame 420. While in one embodiment, three each of the support rollers 450 are disposed on each of the sides, one each of the support roller 450 may be disposed on each of the sides, or two or more each may be disposed in another embodiment.

In the above-described embodiment, the support roller 450 can support a load in a horizontal direction applied from the substrate WF during polishing. For example, in a state illustrated in FIG. 14, assume that force is applied in a left direction from the substrate WF to the retainer member 3. In such a case, the support pad 418 installed on the retainer support guide 412 of the retainer portion 380 (FIG. 14) in the right side of the top ring 302 presses the support roller 450 in the left direction. The support roller 450 has a shaft 424 secured to the retainer support frame 420, and the retainer support frame 420 is secured to the lower member 306. Therefore, it is possible to prevent the support roller 450 from receiving the load to move the retainer member 3 in the horizontal direction when the force in the horizontal direction is applied to the retainer member 3.

In the above-described embodiment, the top ring shaft 18 has rotational force that is transmitted to the upper member 303, the intermediate member 304, and the lower member 306. Furthermore, the rotational force is transmitted to the support roller 450 from the retainer support frame 420 secured to the lower member 306, and is transmitted to the retainer portion 380 from the support roller 450 through the support pad 418. Therefore, rotational force of the top ring main body 2 of the top ring 302 is transmitted to the retainer portion 380 through the support roller 450.

In the above-described embodiment, the fluid is supplied to the cylinder 406 through the passage 403, and the diaphragm 408 drives the piston 410, and thus, the retainer member 3 is moved in the up and down direction such that the retainer member 3 can be pressed onto the polishing pad 352. The pressure of the fluid supplied to the cylinder 406 can control the pressure that presses the retainer member 3 to the polishing pad 352. In the above-described embodiment, when the retainer member 3 moves in the up and down direction, the retainer member 3 moves guided by the support roller 450. Therefore, resistance between the support roller 450 and the support pad 418 can be decreased.

In the embodiment illustrated in FIG. 14, the bonded regions of the respective sheet materials 320*a*, 320*b*, 320*c*, and 320*d* of the laminated membrane 320 are not limited. FIG. 15A to FIG. 15D are drawings illustrating examples of the bonded regions of the laminated membrane 320. The laminated membrane 320 according to the embodiment illustrated in FIG. 15A has four sheet materials 320*a*, 320*b*, 320*c*, and 320*d* laminated. The laminated membrane 320 illustrated in FIG. 15A has the lower surface of the second sheet material 320*b* bonded on the upper surface of the first sheet material 320*a* excluding the region where the first pressure chamber 322*a* is formed. The lower surface of the third sheet material 320*c* is bonded on the upper surface of the second sheet material 320*b* excluding the region where the second pressure chamber 322*b* is formed. The lower surface of the fourth sheet material 320*d* is bonded on the upper surface of the third sheet material 320*c* excluding the region where the third pressure chamber 322*c* is formed. Note that FIG. 15A does not illustrate the vacuum suction hole 328 for vacuum suctioning the substrate WF, the vacuum suction hole may be provided or does not have to be provided. In the embodiment illustrated in FIG. 15A, the first pressure chamber 322*a* is defined between the first sheet material 320*a* and the second sheet material 320*b*, the second pressure chamber 322*b* is defined between the second sheet material 320*b* and the third sheet material 320*c*, the third pressure chamber 322*c* is defined between the third sheet material 320*c* and the fourth sheet material 320*d*, and the fourth pressure chamber 322*d* is defined between the fourth sheet material 320*d* and the lower member 306. In the embodiment illustrated in FIG. 14A, the first pressure chamber 322*a*, the second pressure chamber 322*b*, the third pressure chamber 322*c*, and the fourth pressure chamber 322*d* are defined from the outside toward the center. Therefore, controlling the pressures of the respective pressure chambers 322*a*, 322*b*, 322*c*, and 322*d* ensures controlling pressing force to the polishing pad 352 of the substrate WF held under the laminated membrane 320 for each of the regions.

Figure 15A:
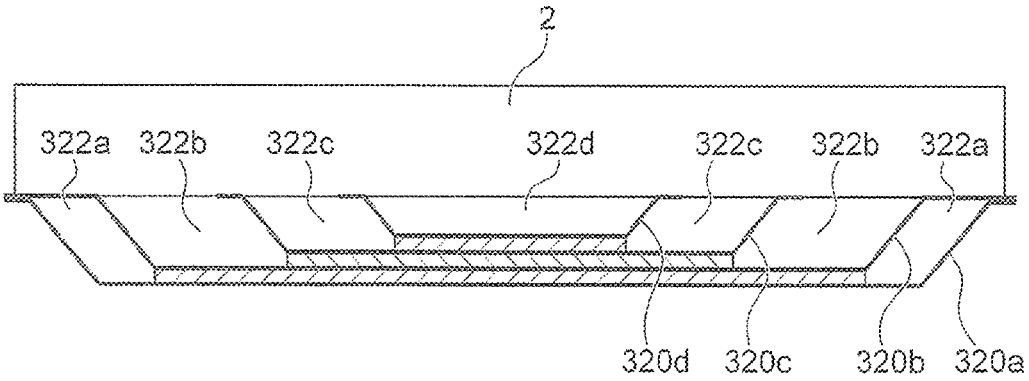
FIG. 15A is a cross-sectional view schematically illustrating bonded regions of the laminated membrane according to one embodiment.
Figure 15B:
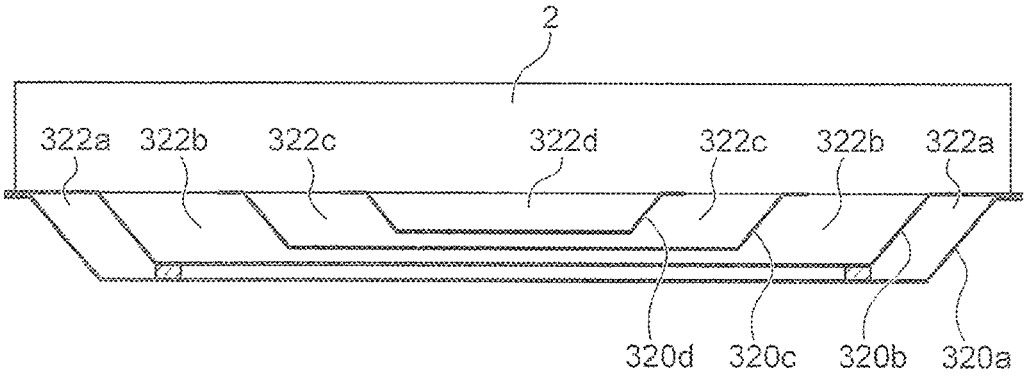
FIG. 15B is a cross-sectional view schematically illustrating bonded regions of the laminated membrane according to one embodiment.

In the embodiment illustrated in FIG. 15B, the laminated membrane 320 has four sheet materials 320*a*, 320*b*, 320*c*, and 320*d* laminated. The laminated membrane 320 illustrated in FIG. 15B has a part of the lower surface of the second sheet material 320*b* is coupled to a part of the upper surface of the first sheet material 320*a*. The bonded region illustrated in FIG. 15B extends in the circumferential direction of the sheet material. Accordingly, in the embodiment illustrated in FIG. 15B, the coupled region between the first sheet material 320*a* and the second sheet material 320*b* makes a boundary of the first pressure chamber 322*a*. In the embodiment illustrated in FIG. 15B, no bonding is made between the second sheet material 320*b*, the third sheet material 320*c*, and the fourth sheet material 320*d*. In the embodiment illustrated in FIG. 15B, the laminated membrane 320 is not provided with the vacuum suction hole for vacuum suctioning the substrate WF.

In the embodiment illustrated in FIG. 15B, the substrate WF is held on a front side surface (lower side surface) of the first sheet material 320*a* during polishing. During the polishing, when the pressures in the pressure chambers are controlled to increase in the order of the fourth pressure chamber 322*d*, the third pressure chamber 322*c*, and the second pressure chamber 322*b* from the center side toward the outside of the substrate, the pressing force onto the polishing pad 352 of the substrate WF can be controlled for each pressure chamber without the bonding between the sheet materials. On the other hand, when the substrate WF is pulled away from the polishing pad 352 after finishing the polishing of the substrate WF, providing a positive pressure to the first pressure chamber 322*a* and providing a negative pressure to the second pressure chamber 322*b*, the third pressure chamber 322*c*, and the fourth pressure chamber 322*d* ensures holding the substrate WF under the first sheet material 320*a* like a suction cup to pull the substrate WF away from the polishing pad 352.

Figure 15C:
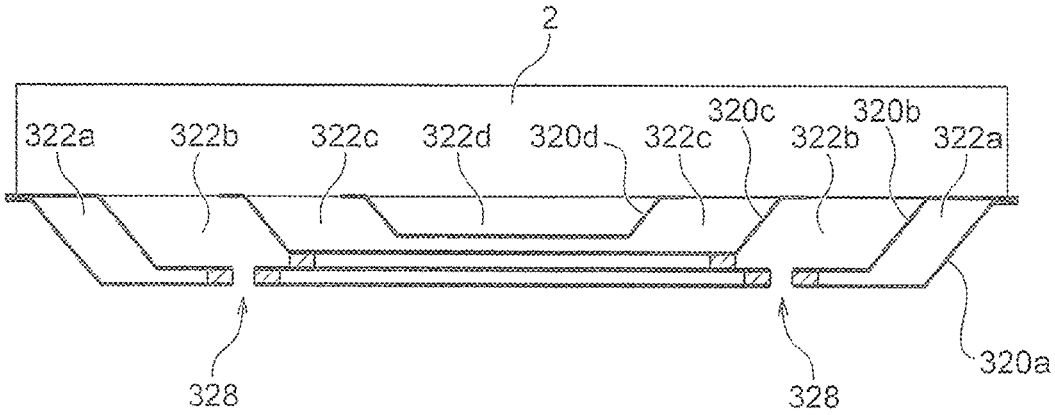
FIG. 15C is a cross-sectional view schematically illustrating bonded regions of the laminated membrane according to one embodiment.

In the embodiment illustrated in FIG. 15C, the laminated membrane 320 has four sheet materials 320*a*, 320*b*, 320*c*, and 320*d* laminated. The laminated membrane 320 illustrated in FIG. 15C is provided with the vacuum suction holes 328 that pass through the second sheet material 320*b* and the first sheet material 320*a*. In the embodiment of FIG. 15C, the second sheet material 320*b* and the first sheet material 320*a* are bonded in peripheral areas of the vacuum suction holes 328. In the embodiment of FIG. 15C, vacuum drawing the second pressure chamber 322*b* ensures holding the substrate WF under the laminated membrane 320. Furthermore, in one embodiment, as illustrated in FIG. 15C, in the region that serves as a boundary between the second pressure chamber 322*b* and the third pressure chamber 322*c*, the third sheet material 320*c* and the second sheet material 320*b* are bonded across the circumferential direction as illustrated. Such a bonding is for preventing a liquid including slurry and the like from entering into the second pressure chamber 322*b* from the vacuum suction hole 328, and further ingressing between the third sheet material 320*c* and the second sheet material 320*b* when the second pressure chamber 322*b* is vacuum drawn.

In the embodiment illustrated in FIG. 15C, the substrate WF is held on a front side surface of the first sheet material 320*a* during polishing. During the polishing, when the pressures in the pressure chambers are controlled to increase in the order of the fourth pressure chamber 322*d*, the third pressure chamber 322*c*, the second pressure chamber 322*b*, and the first pressure chamber 322*a* from the center side toward the outside of the substrate, the pressing force onto the polishing pad 352 of the substrate WF can be controlled for each pressure chamber. On the other hand, when the substrate WF is pulled away from the polishing pad 352 after finishing the polishing of the substrate WF, providing a negative pressure to all the pressure chambers including the second pressure chamber 322*b* ensures holding the substrate WF under the first sheet material 320*a* by vacuum suctioning to pull the substrate WF away from the polishing pad 352. Note that when the substrate WF is pulled away from the polishing pad 352, as long as a negative pressure is provided to the second pressure chamber 322*b*, the first pressure chamber 322*a*, the third pressure chamber 322*c*, and the fourth pressure chamber 322*d* may have atmospheric pressures.

Figure 15D:
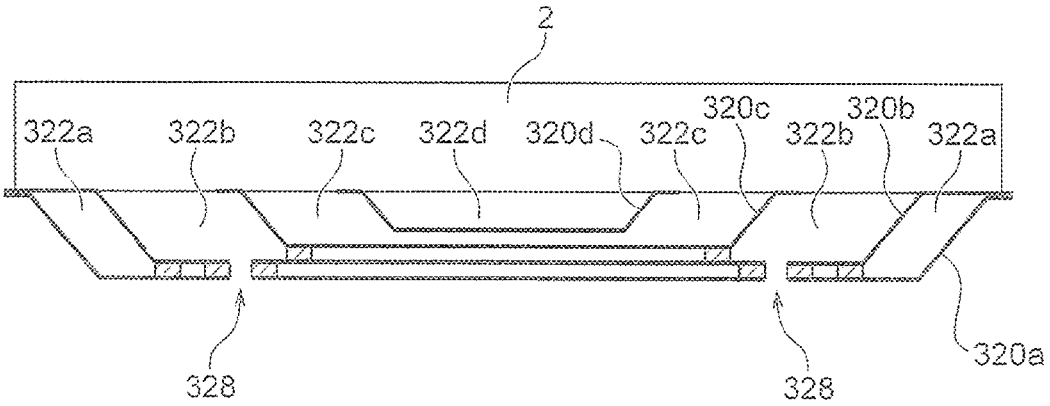
FIG. 15D is a cross-sectional view schematically illustrating bonded regions of the laminated membrane according to one embodiment.

In the embodiment illustrated in FIG. 15D, the laminated membrane 320 has four sheet materials 320*a*, 320*b*, 320*c*, and 320*d* laminated. The laminated membrane 320 illustrated in FIG. 15D is provided with the vacuum suction holes 328 that pass through the second sheet material 320*b* and the first sheet material 320*a*. In the embodiment of FIG. 15D, the second sheet material 320*b* and the first sheet material 320*a* are bonded in peripheral areas of the vacuum suction holes 328. As illustrated in FIG. 15D, in the region that serves as a boundary between the second pressure chamber 322*b* and the third pressure chamber 322*c*, the third sheet material 320*c* and the second sheet material 320*b* are bonded across the circumferential direction as illustrated. Furthermore, as illustrated in FIG. 15D, in the region that serves as a boundary between the second pressure chamber 322*b* and the first pressure chamber 322*a*, the second sheet material 320*b* and the first sheet material 320*a* are bonded as illustrated. The embodiment illustrated in FIG. 15D is said to be a combination of the embodiments in FIG. 15B and FIG. 15C.

In the embodiment illustrated in FIG. 15D, the substrate WF is held on a front side surface of the first sheet material 320*a* during polishing. Increasing the pressure in the fourth pressure chamber 322*d* greater than that in the third pressure chamber 322*c* during polishing ensures controlling the pressing force onto the polishing pad 352 of the substrate WF for each of the pressure chambers without a bonded layer between the fourth sheet material 320*d* and the third sheet material 320*c*. On the other hand, when the substrate WF is pulled away from the polishing pad 352 after finishing the polishing of the substrate WF, providing a positive pressure to the first pressure chamber 322*a* and providing a negative pressure to the second pressure chamber 322*b*, the third pressure chamber 322*c*, and the fourth pressure chamber 322*d* ensures vacuum suctioning the substrate WF and holding the substrate WF under the first sheet material 320*a* like a suction cup to pull the substrate WF away from the polishing pad 352. Note that when the substrate WF is pulled away from the polishing pad 352, the third pressure chamber 322*c* and the fourth pressure chamber 322*d* may have atmospheric pressures.

Figure 16A:
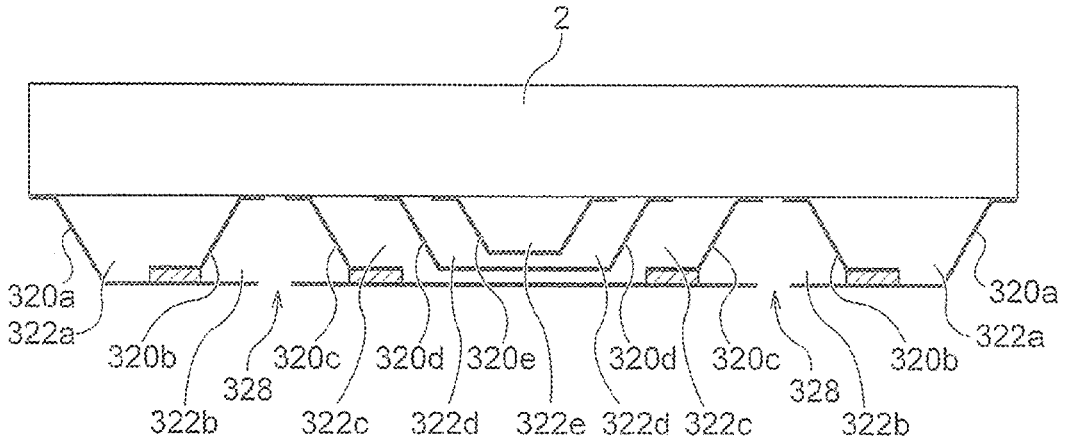
FIG. 16A is a cross-sectional view schematically illustrating bonded regions of the laminated membrane according to one embodiment.

FIG. 16A is a drawing illustrating an example of bonded regions of the laminated membrane 320 according to one embodiment. In the laminated membrane 320 according to the embodiment illustrated in FIG. 16A, the plurality of sheet materials 320*a*, 320*b*, 320*c*, 320*d*, and 320*e* are laminated. As illustrated in FIG. 16A, a part of the upper surface of the first sheet material 320*a* is bonded on a part of the lower surface of the second sheet material 320*b*. Therefore, the first sheet material 320*a* and the second sheet material 320*b* define the first pressure chamber 322*a*. As illustrated in FIG. 16A, a part of the upper surface of the first sheet material 320*a* is bonded on a part of the lower surface of the third sheet material 320*c*. Therefore, the first sheet material 320*a*, the second sheet material 320*b*, and the third sheet material 320*c* define the second pressure chamber 322*b*. The bonded region illustrated in FIG. 16A extends in the circumferential direction of the sheet materials. Note that, as illustrated in FIG. 16A, the second pressure chamber 322*b* is adjacent to the first pressure chamber 322*a*, and the second pressure chamber 322*b* is located inside with respect to the first pressure chamber 322*a*. As illustrated in FIG. 16A, in the proximity of the center of the first sheet material 320*a*, the fourth sheet material 320*d* is disposed in an upper side of the first sheet material 320*a*. As illustrated, the first sheet material 320*a*, the third sheet material 320*c*, and the fourth sheet material 320*d* define the third pressure chamber

322*c*. Note that the first sheet material 320*a* and the fourth sheet material 320*d* are not bonded. As illustrated in FIG. 16A, in the proximity of the center of the first sheet material 320*a* and the fourth sheet material 320*d*, a fifth sheet material 320*e* is disposed in an upper side of the fourth sheet material 320*d*. As illustrated, the fourth sheet material 320*d* and the fifth sheet material 320*e* define the fourth pressure chamber 322*d*. As illustrated, the fifth sheet material 320*e* defines a fifth pressure chamber 322*e*. Note that the fourth sheet material 320*d* and the fifth sheet material 320*e* are not bonded. As illustrated in FIG. 16A, a part of the first sheet material 320*a* that defines the second pressure chamber 322*b* is provided with the vacuum suction holes 328.

Figure 16B:
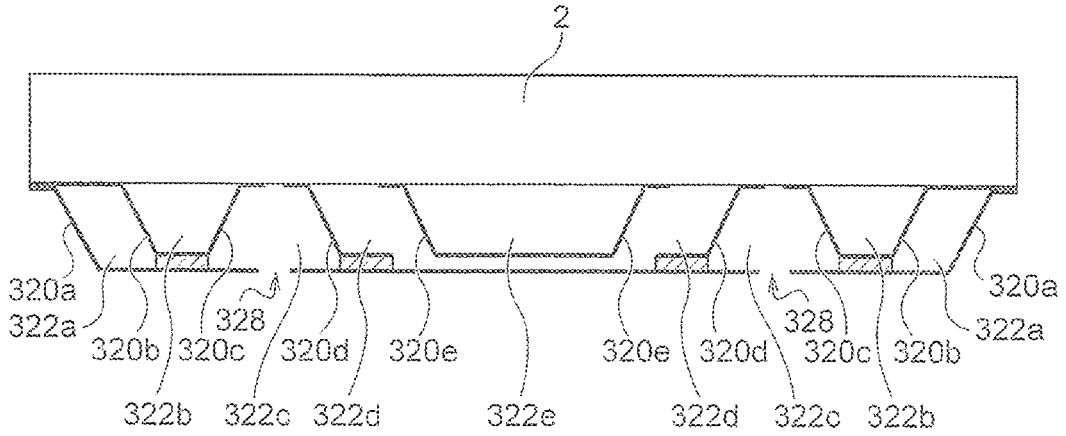
FIG. 16B is a cross-sectional view schematically illustrating bonded regions of the laminated membrane according to one embodiment.

FIG. 16B is a drawing illustrating an example of bonded regions of the laminated membrane 320 according to one embodiment. The laminated membrane 320 according to the embodiment illustrated in FIG. 16B has the plurality of sheet materials 320*a*, 320*b*, 320*c*, 320*d*, and 320*e* laminated. As illustrated in FIG. 16B, a part of the upper surface of the first sheet material 320*a* is bonded on a part of the lower surface of the second sheet material 320*b*. Therefore, the first sheet material 320*a* and the second sheet material 320*b* define the first pressure chamber 322*a*. As illustrated in FIG. 16B, the second sheet material 320*b* and the third sheet material 320*c* define the second pressure chamber 322*b*. Note that the second sheet material 320*b* and the third sheet material 320*c* may be an identical sheet material, and in the example illustrated in FIG. 16B, an outer portion from the bonded region is the second sheet material 320*b*, and an inner portion from the bonded region is the third sheet material 320*c*. As illustrated in FIG. 16B, a part of the upper surface of the first sheet material 320*a* is bonded on a part of the lower surface of the fourth sheet material 320*d*. Therefore, the first sheet material 320*a*, the third sheet material 320*c*, and the fourth sheet material 320*d* define the third pressure chamber 322*c*. Note that the bonded region illustrated in FIG. 16B extends in the circumferential direction of the sheet material. As illustrated in FIG. 16B, in the proximity of the center of the first sheet material 320*a*, the fifth sheet material 320*e* is disposed in an upper side of the first sheet material 320*a*. As illustrated, the first sheet material 320*a*, the fourth sheet material 320*d*, and the fifth sheet material 320*e* define the fourth pressure chamber 322*d*. Note that the first sheet material 320*a* and the fifth sheet material 320*e* are not bonded. As illustrated, the fifth sheet material 320*e* defines the fifth pressure chamber 322*e*. As illustrated in FIG. 16B, a part of the first sheet material 320*a* that defines the third pressure chamber 322*c* is provided with the vacuum suction holes 328.

The embodiment of the present invention has been described above based on some examples in order to facilitate understanding of the present invention without limiting the present invention. The present invention can be changed or improved without departing from the gist thereof, and of course, the equivalents of the present invention are included in the present invention. It is possible to arbitrarily combine or omit respective components according to claims and description in a range in which at least a part of the above-described problems can be solved, or a range in which at least a part of the effects can be exhibited. Note that, while in the above-mentioned examples, the top ring has been described as for holding a square shaped substrate, and the laminated membrane has also been illustrated and described as having a shape corresponding to the square shaped substrate, the top ring may be for holding a circular shaped substrate, and the laminated membrane may also have a shape corresponding to the circular shaped substrate.

From the above-described embodiments, at least the following technical ideas are obtained.

[Configuration 1]

According to a configuration 1, a laminated membrane used in a substrate holder of a substrate processing apparatus is provided. Such a laminated membrane includes a first sheet material, and a second sheet material disposed on the first sheet material. A part of the first sheet material is secured to a part of the second sheet material.

[Configuration 2]

According to a configuration 2, in the laminated membrane according to the configuration 1, the part of the first sheet material is secured to the part of the second sheet material with an adhesive.

[Configuration 3]

According to a configuration 3, in the laminated membrane according to the configuration 1, the part of the first sheet material is secured to the part of the second sheet material by vulcanization bonding.

[Configuration 4]

According to a configuration 4, a substrate holder of a substrate processing apparatus is provided. Such a substrate holder includes the laminated membrane according to any one of the configurations 1 to 3. The laminated membrane has a substrate holding surface configured to hold a substrate.

[Configuration 5]

According to a configuration 5, the substrate holder according to the configuration 4 includes a first holder configured to position the first sheet material, and a second holder configured to position the second sheet material. A first pressure chamber is defined between the first sheet material and the second sheet material.

[Configuration 6]

According to a configuration 6, a method for manufacturing a laminated membrane used in a substrate holder of a substrate processing apparatus is provided. Such a method for manufacturing includes a step of preparing a first sheet material and a second sheet material, a step of performing a surface reforming process on a part of an upper surface of the first sheet material and a part of a lower surface of the second sheet material, a step of disposing an adhesive on the part of the upper surface of the first sheet material and/or the part of the lower surface of the second sheet material, and a step of disposing the lower surface of the second sheet material on the upper surface of the first sheet material.

[Configuration 7]

According to a configuration 7, a method for manufacturing a laminated membrane used in a substrate holder of a substrate processing apparatus is provided. Such a method for manufacturing includes a step of disposing a first sheet material in a mold that specifies an outer shape of the laminated membrane, a step of disposing a fluororesin sheet on a part of an upper surface of the first sheet material, a step of disposing a second sheet material including unvulcanized rubber on the upper surface of the first sheet material, a step of performing a vulcanizing process on the second sheet material, and a step of removing the fluororesin sheet.

[Configuration 8]

According to a configuration 8, a method for manufacturing a laminated membrane used in a substrate holder of a substrate processing apparatus is provided. Such a method for manufacturing includes a step of coating fluororesin on a part of a first sheet material and/or a second sheet material, a step of disposing the first sheet material in a mold that specifies an outer shape of the laminated membrane, a step of disposing unvulcanized rubber on a part of an upper surface of the first sheet material and/or a part of a lower surface of the second sheet material, a step of disposing the second sheet material on the first sheet material on which the unvulcanized rubber is disposed, and a step of performing a vulcanizing process on the unvulcanized rubber.

[Configuration 9]

According to a configuration 9, a substrate processing apparatus is provided. Such a substrate processing apparatus includes a rotatable table, and the substrate holder according to the configuration 4 or 5. The substrate processing apparatus is configured to polish a substrate by rotating the table in a state where a polishing pad disposed on the table is brought into contact with the substrate held by the substrate holder.

REFERENCE SIGNS LIST

2 . . . top ring main body
3 . . . retainer member
50 . . . dresser
100 . . . loading unit
200 . . . conveyance unit
300 . . . polishing unit
302 . . . top ring
303 . . . upper member
304 . . . intermediate member
306 . . . lower member
316*b* . . . holder
316*c* . . . holder
316*d* . . . holder
320 . . . laminated membrane
320*a* . . . first sheet material
320*b* . . . second sheet material
320*c* . . . third sheet material
320*d* . . . fourth sheet material
320*e* . . . fifth sheet material
322 . . . pressure chamber
322*a* . . . first pressure chamber
322*b* . . . second pressure chamber
322*c* . . . third pressure chamber
322*d* . . . fourth pressure chamber
322*e* . . . fifth pressure chamber
325 . . . first membrane holder
327 . . . second membrane holder
328 . . . vacuum suction hole
350 . . . polishing table
352 . . . polishing pad
356 . . . dressing unit
360 . . . swing arm
362 . . . spindle
380 . . . retainer portion
500 . . . drying unit
600 . . . unloading unit
900 . . . controller
1000 . . . substrate processing apparatus
WF . . . substrate

What is claimed is:

1. A laminated membrane used in a substrate holder of a substrate processing apparatus, the laminated membrane comprising:

a first sheet material; and a second sheet material layered on the first sheet material, wherein a surface part of the first sheet material is secured to a surface part of the second sheet material to form the laminated membrane, wherein one surface of the first sheet material is configured to contact a substrate, and the surface part of the other surface of the first sheet material is secured to the surface part of the second sheet material, wherein at least a portion of the laminated membrane where the one surface contacts the substrate and is secured to the part of the second sheet material are arranged horizontally above the substrate;

a first pressure chamber is defined between the layers of first sheet material and the second sheet material, each of the first and second sheet materials is a material formed of a two-dimensional structure in a natural state without any addition of force, excluding a thickness of the material.

2. The laminated membrane according to claim 1, wherein the part of the first sheet material is secured to the part of the second sheet material with an adhesive.

3. The laminated membrane according to claim 1, wherein the part of the first sheet material is secured to the part of the second sheet material by vulcanization bonding.

4. A substrate holder of a substrate processing apparatus, the substrate holder comprising:

a laminated membrane used in a substrate holder of a substrate processing apparatus, the laminated membrane comprising:

a first sheet material; and a second sheet material layered on the first sheet material, wherein a part of the first sheet material is secured to a part of the second sheet material to form the laminated membrane, wherein one surface of the first sheet material is configured to contact a substrate, and the part of the other surface of the first sheet material is secured to the part of the second sheet material, a first pressure chamber is defined between the layered the first sheet material and the second sheet material each of the first and second sheet materials is a material formed of a two-dimensional structure in a natural state without any addition of force, excluding a thickness of the material, the laminated membrane has a substrate holding surface configured to hold a substrate.

5. The substrate holder according to claim 4, further comprising:

a first holder configured to position the first sheet material; and a second holder configured to position the second sheet material.

6. A substrate processing apparatus comprising:

a rotatable table; and a substrate holder of a substrate processing apparatus, the substrate holder comprising:

a laminated membrane used in a substrate holder of a substrate processing apparatus, the laminated membrane comprising:

a first sheet material; and a second sheet material layered on the first sheet material, wherein a part of the first sheet material is secured to a part of the second sheet material to form the laminated membrane, wherein one surface of the first sheet material is configured to contact a substrate, and the part of the other surface of the first sheet material is secured to the part of the second sheet material, a first pressure chamber is defined between the layered first sheet material and the second sheet material each of the first and second sheet materials is a material formed of a two-dimensional structure in a natural state without any addition of force, excluding a thickness of the material, the laminated membrane has a substrate holding surface configured to hold a substrate, the substrate processing apparatus is configured to polish a substrate by rotating the table in a state where a polishing pad disposed on the table is brought into contact with the substrate held by the substrate holder.

* * * * *